US008031902B2

(12) United States Patent
Takewa

(10) Patent No.: US 8,031,902 B2
(45) Date of Patent: Oct. 4, 2011

(54) LOUDSPEAKER

(75) Inventor: Hiroyuki Takewa, Osaka (JP)

(73) Assignee: Panasonic Corporation, Osaka (JP)

( * ) Notice: Subject to any disclaimer, the term of this patent is extended or adjusted under 35 U.S.C. 154(b) by 1351 days.

(21) Appl. No.: 11/597,287

(22) PCT Filed: May 26, 2005

(86) PCT No.: PCT/JP2005/009655
§ 371 (c)(1),
(2), (4) Date: Nov. 22, 2006

(87) PCT Pub. No.: WO2005/117489
PCT Pub. Date: Dec. 8, 2005

(65) Prior Publication Data

US 2008/0063235 A1 Mar. 13, 2008

(30) Foreign Application Priority Data

May 27, 2004 (JP) ..... 2004-158337

(51) Int. Cl.
*H04R 1/00* (2006.01)
*H04R 9/06* (2006.01)
*H04R 11/02* (2006.01)

(52) U.S. Cl. ..... 381/431; 381/399; 381/400; 381/401; 381/407; 381/408

(58) Field of Classification Search ..... 381/431, 381/399–401, 407–408, 412
See application file for complete search history.

(56) References Cited

U.S. PATENT DOCUMENTS

| | | | | |
|---|---|---|---|---|
| 4,384,173 | A * | 5/1983 | Briefer et al. | 381/431 |
| 5,664,024 | A | 9/1997 | Furuta et al. | |
| 5,764,784 | A | 6/1998 | Sato et al. | |
| 6,654,475 | B2 * | 11/2003 | Nakaso | 381/396 |
| 6,920,957 | B2 | 7/2005 | Usuki et al. | |

FOREIGN PATENT DOCUMENTS

| | | |
|---|---|---|
| EP | 0 680 242 A1 | 11/1995 |
| JP | 57-78300 | 5/1982 |

(Continued)

OTHER PUBLICATIONS

Supplementary European Search Report issued Mar. 18, 2011 in corresponding European Application No. 05 74 3801.

(Continued)

*Primary Examiner* — Davetta W Goins
*Assistant Examiner* — Matthew Eason
(74) *Attorney, Agent, or Firm* — Wenderoth, Lind & Ponack, L.L.P.

(57) ABSTRACT

A loudspeaker comprises a diaphragm, an edge operable to support, on a frame, the diaphragm in such a manner that enables vibration thereof, and a voice coil operable to generate a driving force. The voice coil is of an approximate rectangular shape, and a length of a long axis direction of the voice coil is no less than 60% of a length of a long axis direction of the diaphragm. Positions of long sides of the voice coil to be fixed on the diaphragm are positions corresponding to nodes of a primary resonance mode in a short axis direction of the diaphragm, or in the respective vicinities thereof. Accordingly, it is possible to realize a high sound quality loudspeaker having a narrow width (elongated structure), but not easily causing resonance, thereby obtaining a flat frequency characteristic.

19 Claims, 22 Drawing Sheets

FOREIGN PATENT DOCUMENTS

| | | |
|---|---|---|
| JP | 57-97297 | 6/1982 |
| JP | 59-171489 | 11/1984 |
| JP | 61-168799 | 10/1986 |
| JP | 4-115698 | 4/1992 |
| JP | 7-298389 | 11/1995 |
| JP | 8-102992 | 4/1996 |
| JP | 10-327491 | 12/1998 |
| JP | 2003-47089 | 2/2003 |
| JP | 2004-88739 | 3/2004 |

OTHER PUBLICATIONS

Hiroyuki Takewa et al., "Slim-type Speaker for Flat-panel Televisions", Consumer Electronics, Digest of Technical Papers, International Conference on Las Vegas, NV, USA Jan. 7-11, 2006, Piscataway, NJ, USA, Jan. 7, 2006, IEEE, pp. 237-238, XP010896592, DOI: DOI: 10.1109/ICCE.2006.1598398, ISBN: 978-0-7803-9459-9.

* cited by examiner (a)

(b)

(c)

(a)

(b)

(c)

LOUDSPEAKER

TECHNICAL FIELD

The present invention relates to a loudspeaker, more particularly to a loudspeaker which is improved in slimness and thinness.

BACKGROUND ART

In recent years, a horizontally long television screen is becoming popular due to spread of so-called high definition and wide vision televisions. On the other hand, in consideration of Japanese housing circumstances, a television set which is narrow in width and thin in depth on the whole is desired.

A loudspeaker device (hereinafter referred to as loudspeaker) for the television set is usually mounted on both sides of a CRT display, which results in an increase in width of the TV set. Therefore, the loudspeaker having an elongated structure such as a square type, an elliptic type and the like has traditionally been used for the television set. Further, since the CRT display is lengthened horizontally, the width of the loudspeaker requires to be further narrowed down. Further, high quality in sound comparable to a high-quality screen is required to the loudspeaker. Furthermore, since a thin-screen television using a plasma display or an LCD display is becoming popular, thinning of the loudspeaker is further required.

Here, a conventional elongated (slim type) loudspeaker will be described with reference to a diagram. FIG. 21 is a diagram showing a structure of the conventional slim type loudspeaker. FIG. 21(*a*) is a plan view of the conventional slim type loudspeaker, FIG. 21(*b*) is a cross-sectional view of a longitudinal direction (c-c') of the conventional slim type loudspeaker, and FIG. 21(*c*) is the cross-sectional view of a short axis direction (o-o') thereof. The slim type loudspeaker shown in FIG. 21 comprises a magnet 101, a plate 102, a yoke 103, a frame 104, a voice coil bobbin 105, a voice coil 106, a suspension 107, a diaphragm 109, a dust cap 110, and an edge 111.

The voice coil 106 is a winding of a conductor such as copper and aluminum, and is firmly fixed to the voice coil bobbin 105 having a tubular shape. The voice coil bobbin 105 is connected to the frame 104 via the suspension 107. The voice coil bobbin 105 supports the voice coil 106 such that the voice coil bobbin 105 hangs the voice coil 106 in a magnetic gap 108 comprised of the magnet 101, the plate 102, and the yoke 103. The voice coil bobbin 105 is fixed to the diaphragm 109, having an ellipse or an approximate ellipse shape, on a side opposite to a side which the voice coil 106 is firmly fixed to. The dust cap 110, having an approximate semicircle shape cross-sectional surface, is firmly fixed on a central portion of the diaphragm 109. The edge 111 is of a ring shape, and has a semicircle shape cross-sectional surface, and an inner circumference of the edge 111 is firmly fixed to an outer circumference of the diaphragm 109. An outer circumference of the edge 111 is fixed to the frame 104.

In the case where the loudspeaker shown in FIG. 21 is driven, an electric current is applied to the voice coil 106. With a driving current applied to the voice coil and a magnetic field around the voice coil 106, the voice coil bobbin 105 performs a piston motion, the diaphragm 109 vibrates in a direction of the piston motion. As a result, a sound wave is radiated from the diaphragm 109. Note that the loudspeaker shown in FIG. 21 is described in, for example, Patent Document 1. FIG. 22 is a diagram showing a frequency characteristic with respect to a reproduced sound pressure level of the loudspeaker described in Patent Document 1. In FIG. 22, a vertical axis indicates the reproduced sound pressure level when 1 W of electric power is inputted to the loudspeaker, and a horizontal axis indicates a driving frequency. Note that a microphone to measure the reproduced sound pressure level is on a central axis of the loudspeaker and is located at a position 1 [m] away from the loudspeaker toward the front side thereof.

Patent Document 1: Japanese Laid-Open Patent Publication No. H7-298389

DISCLOSURE OF THE INVENTION

Problems to be Solved by the Invention

The above-described conventional loudspeaker has a following problem. That is, the loudspeaker shown in FIG. 21 applies a driving method which involves driving a central portion of the elongated diaphragm 109, and thus a large number of resonances will occur easily in the longitudinal direction. As a result, the frequency characteristic related to the reproduced sound pressure level becomes such a characteristic that has peaks/dips in middle and high frequencies, which results in deterioration in sound quality. For example, in the characteristic shown in FIG. 22, significant dips can be found in the vicinities of 2 kHz, 3 kHz, and 5 kHz.

The present invention is invented in consideration of the above-described conventional problem, and is directed to provide a high-quality sound loudspeaker which does not easily cause resonance in spite of having a narrow width (elongated structure), and can achieve a flat frequency characteristic.

Solution to the Problems

To achieve the above objects, the present invention has the following aspects. That is, a first aspect is a loudspeaker comprising: a diaphragm having a vertically long flat plate shape; an edge operable to support the diaphragm in such a manner that enables vibration thereof; at least one voice coil directly or indirectly connected to the diaphragm; and a magnetic circuit operable to drive the at least one voice coil. The at least one voice coil is of a vertically long shape, a length of long sides thereof is no less than 60% of a length of a longitudinal direction of the diaphragm, and the long sides thereof are connected to the diaphragm so as to be parallel to the longitudinal direction of the diaphragm. With respect to a short axis direction of the diaphragm, positions where the long sides of the at least one voice coil are connected to the diaphragm are set as positions of nodes of a primary resonance mode in the short axis direction of the diaphragm.

In a second aspect, when a length of the short axis direction of the diaphragm is 1, one long side of two of the long sides of the at least one voice coil is connected at a position corresponding to a distance of 0.224 from one extremity toward another extremity of the short axis direction of the diaphragm. Further, another long side of the at least one voice coil is connected at a position corresponding to a distance of 0.776 from the one extremity toward said another extremity of the short axis direction of the diaphragm.

In a third aspect, the magnetic circuit comprises a magnet having a vertically long shape and located such that a longitudinal direction thereof coincides with the longitudinal direction of the diaphragm and a yoke having a bottom surface connected to the magnet and side surfaces facing long sides of the magnet.

In a fourth aspect, the at least one voice coil is a planar coil which is made of wire and firmly fixed on the diaphragm.

In a fifth aspect, the at least one voice coil is a printed coil provided on the diaphragm.

In a sixth aspect, the diaphragm has a plurality of ribs located at an inner circumference side of a position where the at least one voice coil is connected.

In a seventh aspect, the loudspeaker comprises a plurality of voice coils. The respective voice coils are located in line in the long axis direction of the diaphragm.

In an eighth aspect, a loudspeaker comprises a diaphragm having a vertically long flat plate shape, an edge operable to support the diaphragm in such a manner that enables vibration thereof, at least two voice coils directly or indirectly connected to the diaphragm, and magnetic circuits operable to drive the at least two voice coils and a number thereof is a same as that of the at least two voice coils. The at least two voice coils have a vertically long shape, a length of long sides thereof is no less than 60% of a length of a longitudinal direction of the diaphragm, and the long sides thereof are connected to the diaphragm so as to be parallel to the longitudinal direction of the diaphragm. With respect to a short axis direction of the diaphragm, positions where the long sides of the respective at least two voice coils are connected to the diaphragm are positions where a primary resonance mode and a secondary resonance mode in the short axis direction of the diaphragm are suppressed.

In a ninth aspect, the loudspeaker comprises a first and a second voice coils as the at least two voice coils. When a length of the short axis direction of the diaphragm is 1, one long side of two long sides of the first voice coil is connected at a position corresponding to a distance of 0.113 from one extremity toward another extremity of the short axis direction of the diaphragm, and another long side of the first voice coil is connected to a position corresponding to a distance of 0.37775 from the one extremity toward said another extremity of the short axis direction of the diaphragm. When the length of the short axis direction of the diaphragm is 1, one long side of two long sides of the second voice coil is connected at a position corresponding to a distance of 0.62225 from the one extremity toward said another extremity of the short axis direction of the diaphragm, and another long side of the first voice coil is connected to a position corresponding to a distance of 0.887 from the one extremity toward said another extremity of the short axis direction of the diaphragm.

In a tenth aspect, the loudspeaker comprises a first and a second voice coils, which are respectively located concentrically, as the at least two voice coils. When a length of the short axis direction of the diaphragm is 1, one long side of two long sides of the first voice coil is connected at a position corresponding to a distance of 0.113 from one extremity toward another extremity of the short axis direction of the diaphragm, and another long side of the first voice coil is connected to a position corresponding to a distance of 0.887 from the one extremity toward said another extremity of the short axis direction of the diaphragm. When the length of the short axis direction of the diaphragm is 1, one long side of two long sides of the second voice coil is connected at a position corresponding to a distance of 0.37775 from the one extremity toward said another extremity of the short axis direction of the diaphragm, and another long side of the first voice coil is connected to a position corresponding to a distance of 0.62225 from the one extremity toward said another extremity of the short axis direction of the diaphragm.

In an eleventh aspect, each of the magnetic circuits includes a magnet having a vertically long shape and located such that a longitudinal direction thereof corresponds to the longitudinal direction of the diaphragm, and a yoke having a bottom surface connected to the magnet and side surfaces facing long sides of the magnet.

In a twelfth aspect, each of the at least two voice coils is a planar coil which is made of wire and firmly fixed on the diaphragm.

In a thirteenth aspect, each of the at least two voice coils is a printed coil provided on the diaphragm.

In a fourteenth aspect, the diaphragm has a plurality of ribs located at an inner circumference side of a position where each of the at least two voice coil is connected.

In a fifteenth aspect, a plurality of voice coils among the at least two voice coils is located in line in the long axis direction of the diaphragm.

Further, the present invention may be provided in a form of an electronics device comprising the above-described loudspeaker.

Effect of the Invention

According to the present invention, an occurrence of a resonance mode can be suppressed without making a central part of a diaphragm in a dome shape. Therefore, a high-frequency limit of a loudspeaker can be extended, and slimming and thinning of the loudspeaker can be realized, whereas sound quality thereof is maintained. Specifically, according to a first invention, resonance in a longitudinal direction of the diaphragm can be suppressed, and primary resonance in a short axis direction of the diaphragm is also suppressed. Further, according to an eighth invention, the resonance in the longitudinal direction of the diaphragm can be suppressed, and the primary and secondary resonance in the short axis direction of the diaphragm is also suppressed.

DESCRIPTION OF THE REFERENCE CHARACTERS

Figure 1:
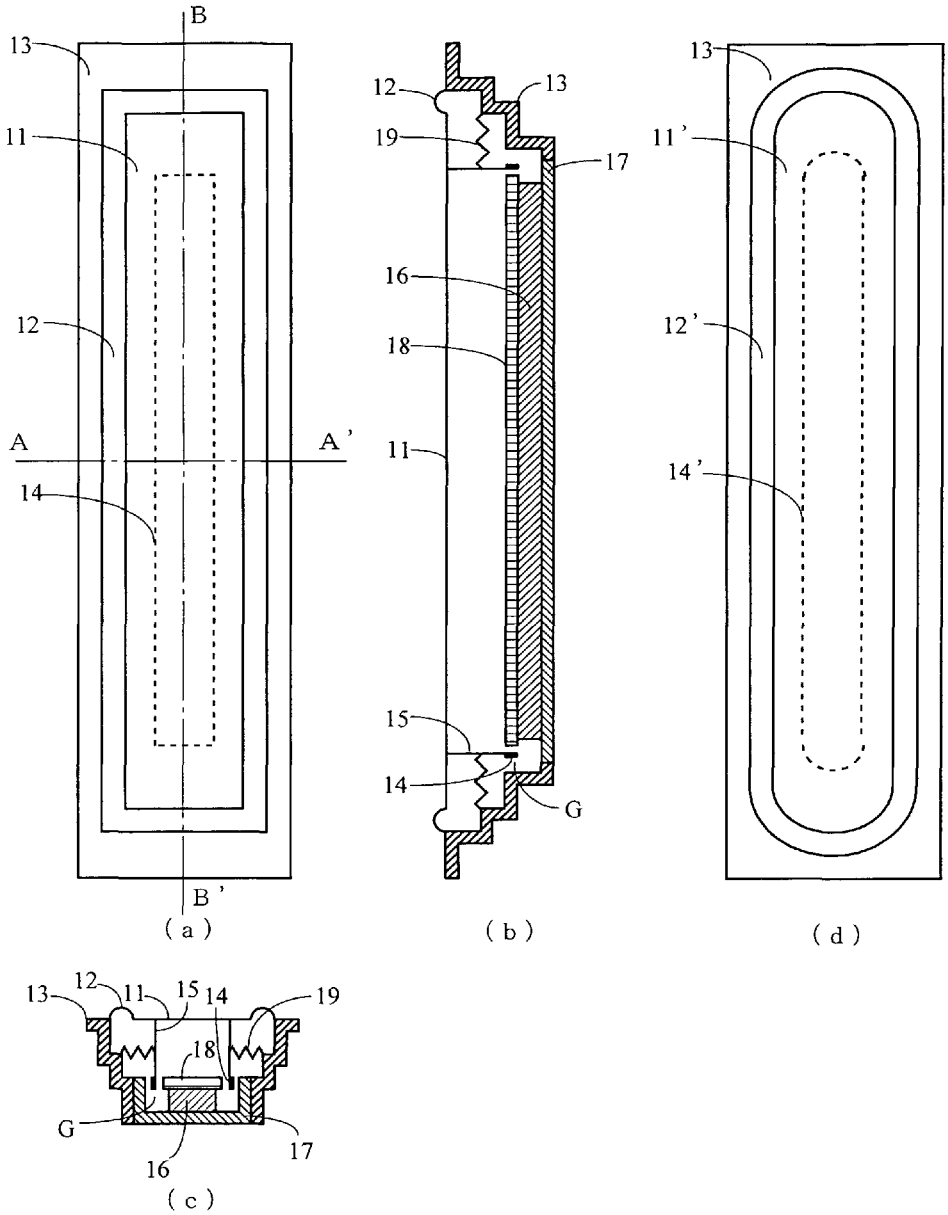
FIG. 1 is a diagram showing a loudspeaker according to embodiment 1 of the present invention.

11 diaphragm
12 edge
13 frame
14 voice coil
15 voice coil bobbin
16 magnet
17 yoke
18 top plate
19 suspension

BEST MODE FOR CARRYING OUT THE INVENTION

Embodiment 1

Hereinafter, a loudspeaker according to embodiment 1 of the present invention will be described. Note that, in FIGS. 1 to 20, component elements respectively having common functions are respectively given common numbers.

FIG. 1(*a*) is a plan view of the loudspeaker according to embodiment 1. FIG. 1(*b*) of a cross-sectional view (B-B' cross-sectional view) in a longitudinal direction of the loudspeaker, and FIG. 1(*c*) is a cross-sectional view of a short axis direction (A-A' cross-sectional view) of the loudspeaker. Further, FIG. 1(*d*) is a plan view showing a diagram having a different shape. The loudspeaker comprises a diaphragm 11, an edge 12, a frame 13, a voice coil 14, a voice coil bobbin 15, a magnet 16, a yoke 17, a top plate 18, and a suspension 19. The loudspeaker is of an elongated shape having a longitudinal direction and a short axis direction, lengths of which are different from each other.

In FIGS. 1(*a*) to (*c*), the diaphragm 11 has a rectangular planar shape. Further, the edge 12 has a ring shape, and a cross-sectional surface thereof is of an approximate semicircle. An outer circumference of the diaphragm 11 is fixed to an inner circumference of the edge 12. The frame 13 is of a ring shape having a opening portion. An outer circumference of the edge 12 is fixed to the opening portion of the frame 13. As shown in FIG. 1(*a*), the diaphragm 11 is of the elongated shape having different lengths of a vertical direction and a lateral direction. Note that, hereinafter, the longitudinal direction of the diaphragm 11 will be referred to as long axis direction (the vertical direction in the FIG. 1(*a*)), and a direction perpendicular to the long axis direction will be referred to as short axis direction (the lateral direction in FIG. 1(*a*).)

Note that the diaphragm and the edge used for the present loudspeaker may be a diaphragm 11' and an edge 12' as shown in FIG. 1(*d*), instead of the diaphragm 11 and the edge 12 which respectively have rectangular shapes. That is, each of the diaphragm and the edge may be, respectively, of a shape such that short sides of two pairs of opposing sides of a rectangle are replaced with semicircles (track shape). Further, the diaphragm and the edge may be elliptical. Further, the diaphragm is not limited to of a planar shape, but may be of a shape such that a central part is raised or sunken in a dome pattern. Paper, lightweight highly rigid metal foil such as aluminum and titanium, or polymer film and the like is suitable as a material of the diaphragm. Note that the diaphragm and the edge may be made of different materials, or may be made of a single material in an integrated manner.

A magnetic circuit is comprised of the magnet 16, the yoke 17, and the top plate 18, and generates magnetic flux in a magnetic gap G. As with the diaphragm 11, the magnet 16, the yoke 17, and the top plate 18 also have rectangular shapes, respectively, when looked from a top surface (a surface at an upper side of FIG. 1(*c*)). The magnet 16 is located such that a longitudinal direction thereof corresponds to the longitudinal direction of the diaphragm. With regard to the yoke 17, a cross-sectional surface thereof, when looked from the long axis direction, has a shape comprising three sides of a rectangle (block C shape). The yoke 17 has one bottom surface and two side surfaces connected thereto. The bottom surface of the yoke 17 is connected to a lower surface of the magnet 16. The side surfaces of the yoke 17 are located in a manner facing long sides of the magnet 16. The top plate 18 is connected to an upper surface of the magnet 16. Note that the yoke 17 does not have side surfaces in the short axis direction. Therefore, the magnetic gap G is formed between long sides of the top plate 18 having a rectangular shape and the side surfaces of the yoke 17. The above-described magnetic circuit is firmly fixed to the frame 13.

On the other hand, the voice coil bobbin 15 having a tubular shape is fixed to the diaphragm 11. A shape of the voice coil bobbin 15, when looked from an upper surface, is a rectangle. The voice coil bobbin 15 is fixed to the diaphragm 11 such that a central axis thereof corresponds to that of the diaphragm 11. Each voice coil bobbin 15 is located such that long sides thereof are in approximate parallel with those of the diaphragm 11. The voice coil 14 is winded around the voice coil bobbin 15. That is, the voice coil 14 is mounted on the diaphragm 11 via the voice coil bobbin 15. The voice coil bobbin 15 is connected to the frame 13 via the suspension 19. Therefore, the voice coil 14 can vibrate due to the suspension 19 and the edge 12. The voice coil 14 is supported by the suspension 19 and the edge 12 such that the voice coil 14 is located in the magnetic gap G. Accordingly, with an application of an electric current to the voice coil 14, a driving power is generated in the voice coil 14.

Next, a position where the voice coil bobbin 15 (voice coil 14) is fixed to the diaphragm 11 will be described. First, with regard to the long axis direction, the voice coil bobbin 15 is fixed to almost a whole area of the diaphragm 11. In the present embodiment, a length of a long axis direction of the voice coil bobbin 15 is no less than 60% of a length of the long axis direction of the diaphragm 11. That is, the voice coil bobbin 15 is fixed to no less than 60% of a part of the diaphragm 11 with respect to the long axis direction.

On the other hand, with regard to the short axis direction, the voice coil bobbin 15 is fixed to positions of nodes of a primary resonance mode on the diaphragm 11 (in the short axis direction). That is, the positions where the long sides of the voice coil bobbin 15 are fixed on the diaphragm 11 are the positions of the nodes of the primary resonance mode in the short axis direction of the diaphragm 11. Here, in the case where rigidity of the diaphragm 11 is higher than that of the edge 12, and the edge 12 is as light in mass as the diaphragm 11, the positions of the nodes of the primary resonance mode in the short axis direction of the diaphragm 11 are, assuming that a length of the short side of the diaphragm 11 is 1, a position corresponding to 0.224 and a position corresponding to 0.776 respectively from an extremity of the short side of the diaphragm. Here, only such modes that have even-numbered nodal lines contributing to the sound pressure characteristic are taken into account, and an order thereof is referred to as primary, secondary, tertiary, etc. In this way, the long sides of the voice coil 14 are fixed to the positions of the nodes of the primary resonance mode in the short axis direction of the diaphragm 11, that is, a position corresponding to 0.224 and a position corresponding to 0.776 respectively from the extremity of the short side of the diaphragm 11 in the case where the length of the short side of the diaphragm is 1. Here, in the case where a constitutional variation in relation to the shape, a weight, or the like of the diaphragm 11 is taken into consideration, a range from 0.2 to 0.25 and a range from 0.75 to 0.8 in the short axis direction of the diaphragm 11 are normally optimal as positions of the long sides of the voice coil 14 to be mounted to the diaphragm 11. Note that in the case where a mass and rigidity of the edge 12 cannot be ignored compared to those of the diaphragm 11, the positions of the nodes of the primary resonance mode on the diaphragm 11 will change from the above-described positions, and thus positions of the voice coil 14 (the voice coil bobbin 15) to be fixed to also require to be moved depending on the positions of the nodes.

As above described, since the diaphragm 11 is driven no less than 60% of the part of the length of the diaphragm 11 in the long axis direction, driving of the diaphragm 11 is almost equivalent to whole area driving. On the other hand, with regard to the short axis direction, the positions of the nodes of the primary resonance mode on the diaphragm 11 are driven.

An operation and effects of the loudspeaker constituted as above described will be described. When the electric current is applied to the voice coil 14, the driving force is generated in the voice coil by the applied electric current and a magnetic field caused by the magnetic circuit. With the generated driving force, the diaphragm 11 vibrates, whereby a sound is radiated in space. Here, according to the loudspeaker of the present embodiment, positions where the driving force is provided to the diaphragm 11 are located to the above-described positions (that is, positions which the voice coil bobbin 15 is fixed to), whereby resonance of the diaphragm 11 can be suppressed. Hereinafter, effects of suppressing the resonance of the diaphragm 11 will be described.

Figure 2:
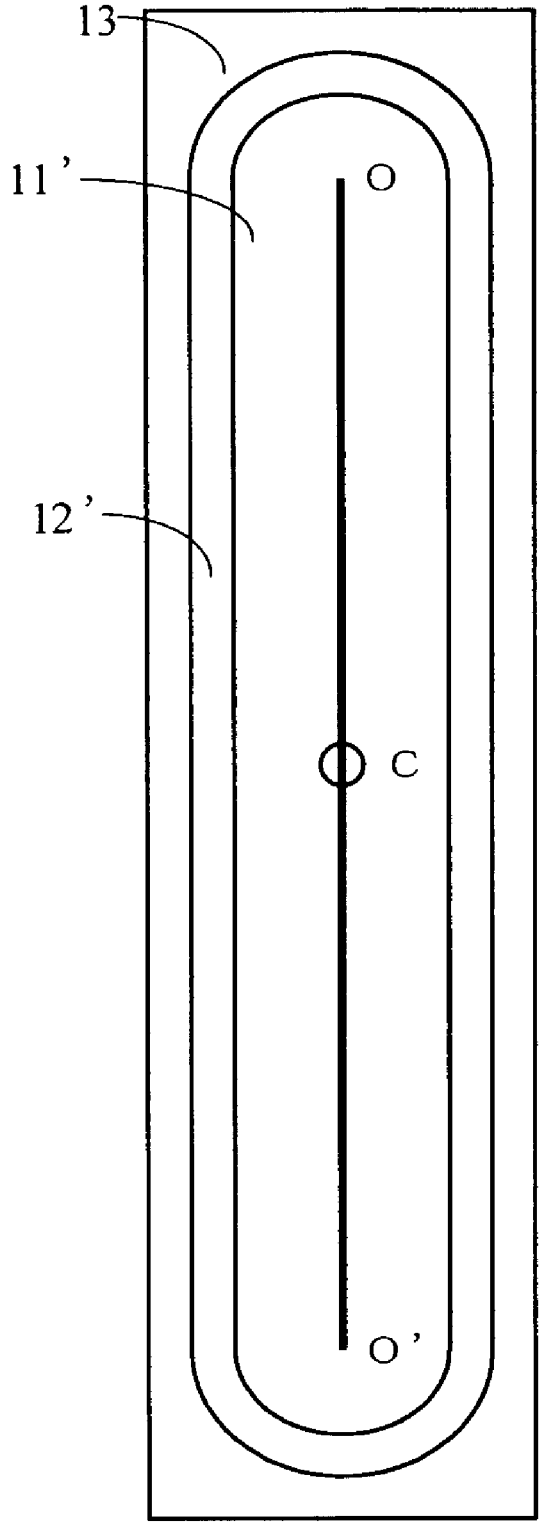
FIG. 2 is a diagram showing a diaphragm used for calculation of a finite element method in embodiment 1.

First, an effect of resonance suppression with regard to the length of the long axis direction of the diaphragm 11 will be described. FIG. 2 is a diagram showing a plan view of the diaphragm and a position of a driving point used for a calculation of a sound pressure/frequency characteristic. As shown in FIG. 2, hereinafter, a case where the diaphragm 11' shown in FIG. 1(*d*) is used will be described as an example. Here, a case where a central point C (a white circle shown in FIG. 2) of the diaphragm 11' with respect to the long axis direction is driven and a case where a line segment O-O' is driven will be described. Note that the diaphragm 11' and the edge 12' are molded with polymer film several tens of microns thick, and the diaphragm 11' and the edge 12' are made of a single material. Further, the diaphragm 11' has the above-described track shape, the length of the long axis direction of the diaphragm 11' is 55 [mm], and the length of the short axis direction of the diaphragm 11' is 11 [mm].

Figure 3:
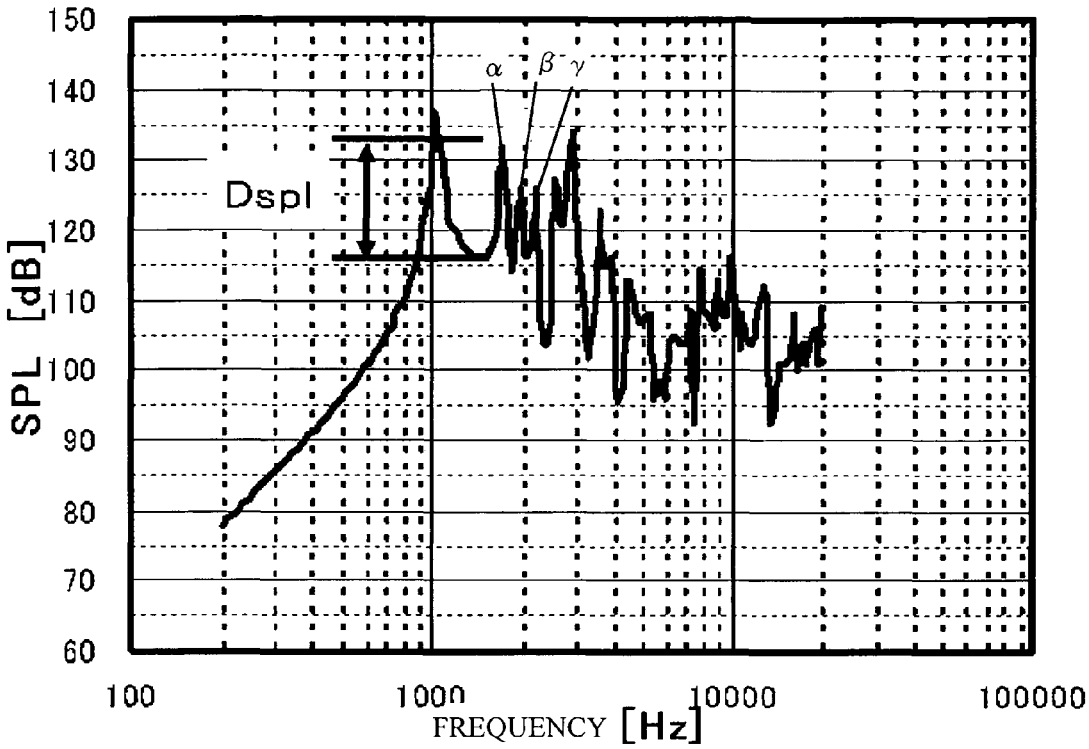
FIG. 3 is a diagram showing a calculation result of a sound pressure/frequency characteristic depending on variation in a driving point.

FIG. 3 is a diagram showing the sound pressure/frequency characteristic in the case where the diaphragm 11' is driven at the central point with respect to the long axis direction. In FIG. 3, a vertical axis indicates a reproduced sound pressure level (SPL) at a position which is on a central axis of the diaphragm 11' and 1 [m] away from the diaphragm 11' toward the front surface side, and a horizontal axis indicates a driving frequency. A characteristic shown in FIG. 3 is a result of calculation, based on a finite element method, of the sound pressure/frequency characteristic in the case where 0.5[N] of the driving force is applied to the diaphragm 11.

Figure 4:
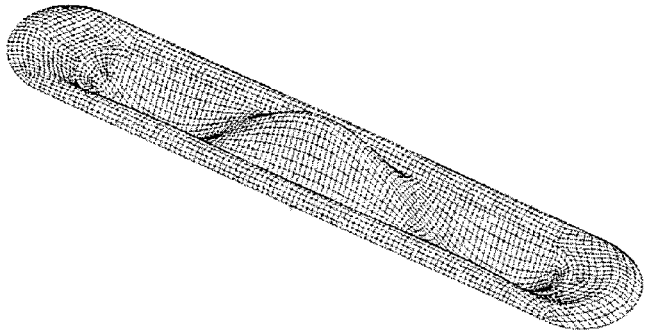
FIG. 4 is a diagram showing a resonance mode in a long axis direction of the diaphragm.
Figure 4:
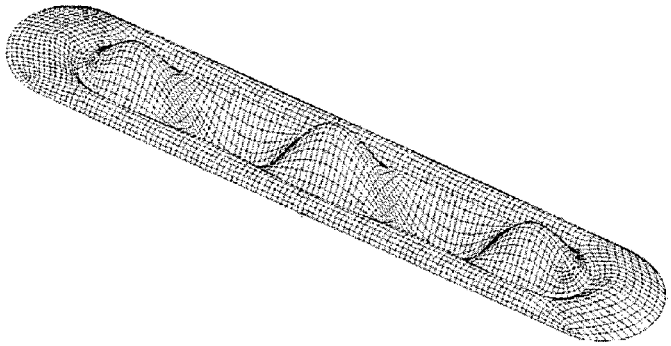
Figure 4:
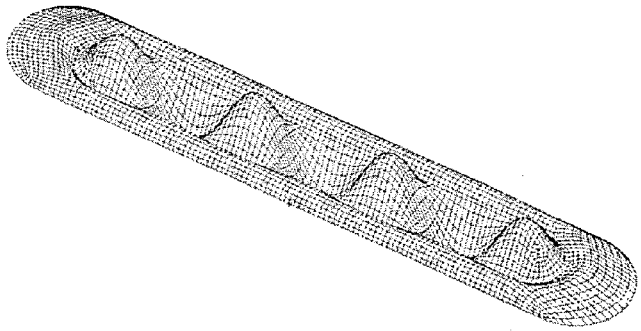

As shown in FIG. 3, in the case where a center of the diaphragm is driven, a large amount of resonance will be induced, and it is clear that the sound pressure/frequency characteristic will be such characteristics that has many peaks and dips. Here, according to a study of vibration modes corresponding to respective sound pressure peaks $\alpha$ $\beta$ and $\gamma$ of the characteristic shown in FIG. 3, it is clear that the vibration modes are such vibration modes that are caused by the resonance in the long axis direction. (*a*) to (*c*) of FIG. 4 is a diagram showing a resonance mode in the long axis direction of the diaphragm. That is, FIG. 4(*a*) shows a primary resonance mode, FIG. 4(*b*) shows a secondary resonance mode, and FIG. 4(*c*) shows a tertiary resonance mode. Note that, in FIG. 4, only such modes that have even-numbered node lines contributing to the sound pressure characteristic are taken into account, and the order thereof is referred to as primary, secondary, tertiary, etc. According to FIGS. 3 and 4, it is clear that the order of the mode is increasing at a very narrow frequency interval.

Figure 5:
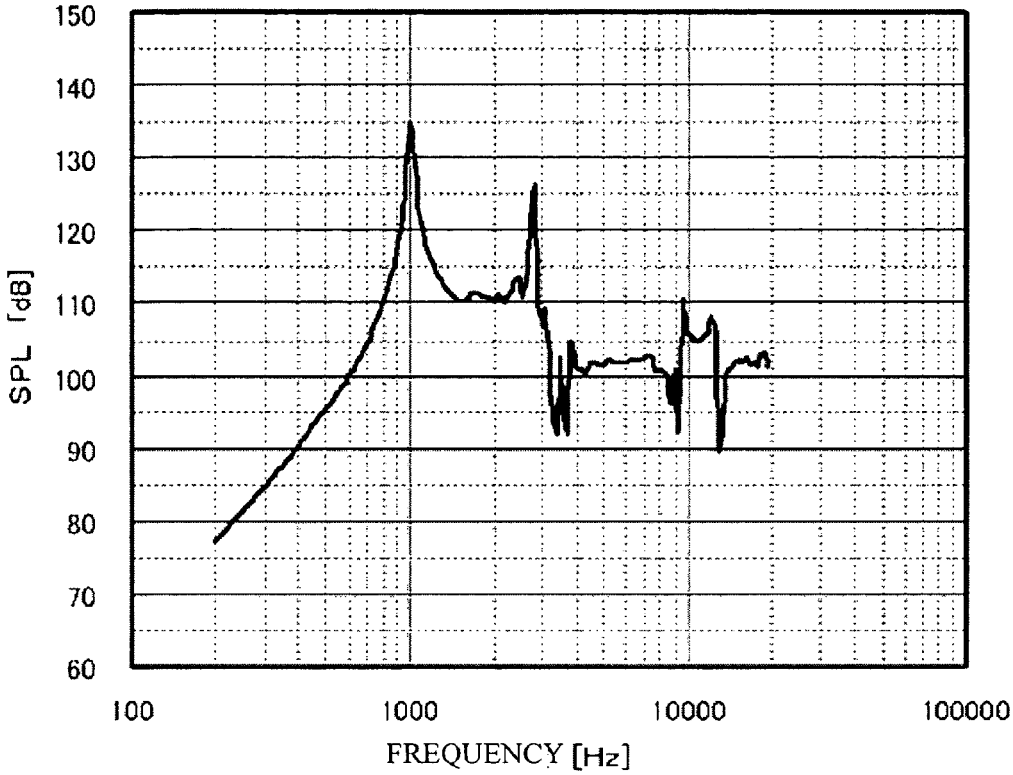
FIG. 5 is a diagram showing a calculation result of the sound pressure/frequency characteristic depending on the variation in the driving point.

On the other hand, FIG. 5 is a diagram showing the sound pressure/frequency characteristic of the loudspeaker in the case where the line segment O-O' of the diaphragm 11' is driven. The characteristic shown in FIG. 5 is based on the same condition as that in the case of FIG. 3 except that a position of the driving power to be provided to on the diaphragm 11' is different. In the case where the diaphragm 11' is driven at the position of the line segment O-O', the resonance in the long axis direction is suppressed, and thus, as shown in FIG. 5, the sound pressure peaks $\alpha$ to $\gamma$ of the characteristic shown in FIG. 3 are suppressed, and consequently the sound pressure/frequency characteristic becomes flat significantly. Accordingly, the driving force is provided to a whole of the long axis direction of the diaphragm, whereby the resonance mode in the long axis direction can be suppressed.

Figure 6:
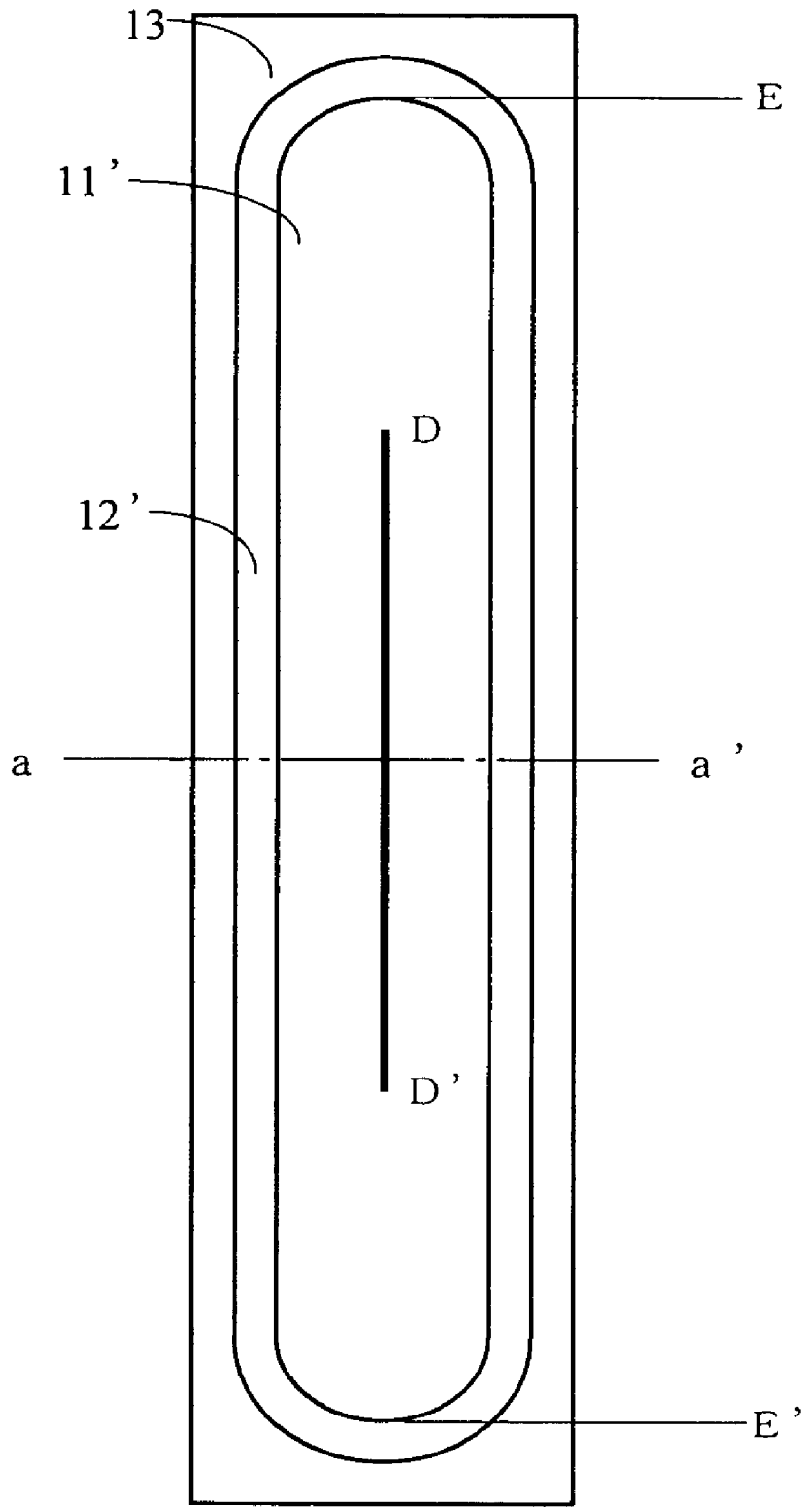
FIG. 6 is a plan view illustrating a driving method of the diaphragm.
Figure 7:
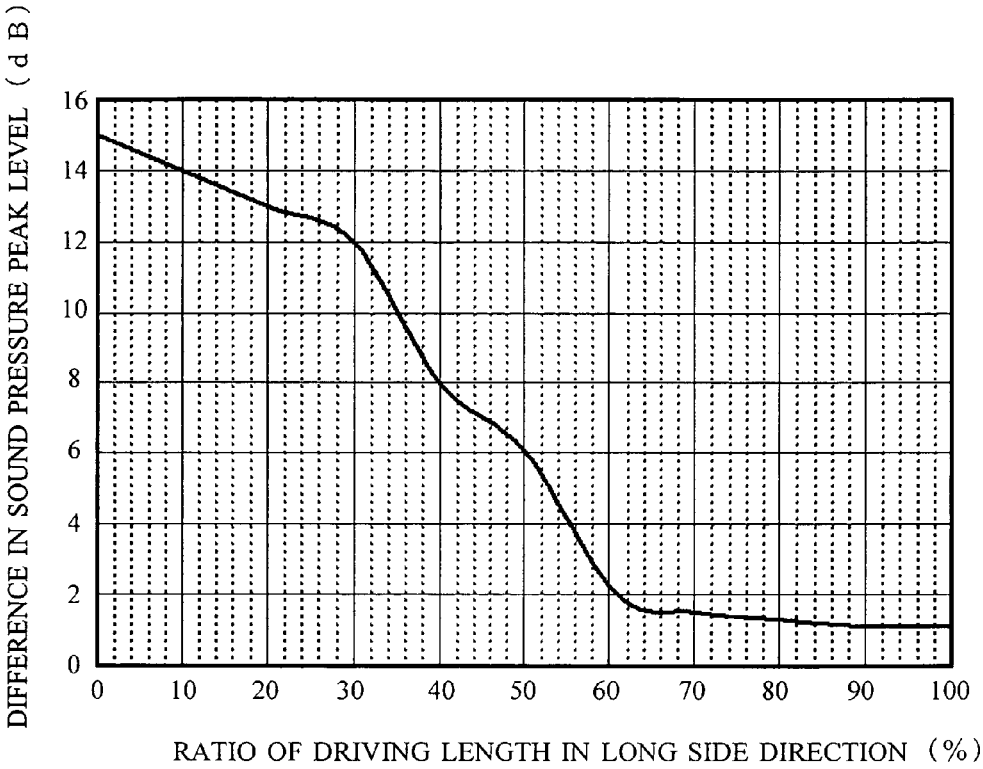
FIG. 7 is a diagram showing a calculation result showing a relation between a ratio of a length of a long side of the diaphragm to a driving length D-D' and an amplitude of a peak level of a sound pressure caused by the resonance mode.

When a length (a length of the line segment O-O') of a portion, to which the driving force is provided on the diaphragm 11', varies, an effect of mode suppression in the long axis direction also varies. FIG. 6 is a diagram illustrating the diaphragm 11' when the length of the portion, to which the driving force is provided on the diaphragm 11', varies. In FIG. 6, the driving force is provided to a line segment D-D'. Here, a relation between a ratio of a length E-E' of the long axis direction of the diaphragm 11' to a driving length D-D' and a difference in levels of the sound pressure peaks caused by the resonance mode ("Dspl" shown in FIG. 3) has been calculated based on the finite element method. A result of the calculation is shown in FIG. 7. FIG. 7 is a diagram showing a relation between the length of the portion of the driving force to be provided on the diaphragm 11' and the levels of the sound pressure peaks caused by the resonance mode. In FIG.

7, a vertical axis indicates the difference in the sound pressure peak levels, and the horizontal axis indicates the ratio of the length E-E' of the long axis direction of the diaphragm 11' to the driving length D-D'. A characteristic shown in FIG. 7 shows the difference in the sound pressure peak levels ranging from that in a case where only the center of the diaphragm is driven (E-E'/D-D'=0) to that in a case where the whole of the long axis direction is driven (E-E'/D-D'=100).

It is clear from the characteristic shown in FIG. 7 that as the driving length in the long axis direction of the diaphragm increases, the difference in the sound pressure peak levels becomes small. Further, in the case where ratio of the driving length D-D' to the length E-E' of the long axis direction of the diaphragm 11' is no less than 60%, it is clear that the sound pressure peak, which is a disturbance of the sound pressure/frequency characteristic, is suppressed, and the difference in the sound pressure peak levels becomes almost flat. Furthermore, it is clear that, in a range where the above-described ratio is more than 60%, a degree of a decrease in the difference in the sound pressure levels is smaller compared to a range where the above-described ratio is no more than 60%. Accordingly, it is clear that when the diaphragm is driven in a length of 60% of the length of the long axis direction of the diaphragm, the vibration mode in the long axis direction can be suppressed sufficiently.

Figure 8:
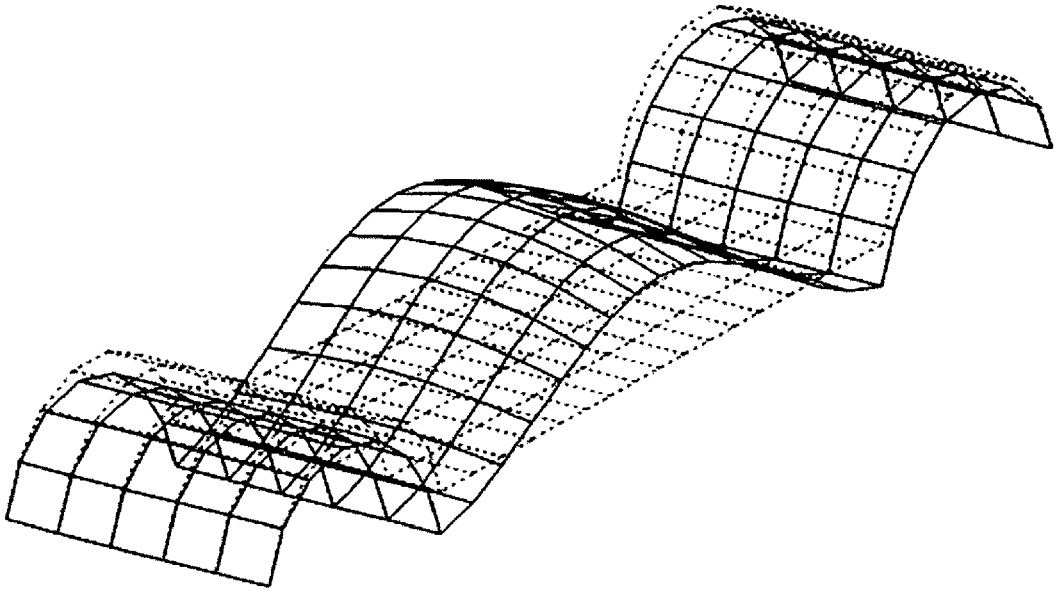
FIG. 8 is a diagram showing a calculation result of a primary resonance mode in a short axis direction.

Next, the effect of the resonance suppression with respect to the length of the short axis direction of the diaphragm 11 will be described. The characteristic shown in FIG. 5 is the sound pressure/frequency characteristic in the case where the vibration mode in the long axis direction is suppressed, and has a large peak in the vicinity of 2.8 [kHz]. It is clear from a study of the vibration mode in the vicinity of the frequency (2.8 [kHz]) that the vibration mode is a primary resonance mode in the short axis direction. FIG. 8 is a diagram showing a model which shows respective elements on both sides of a central line (a line segment a-a' shown in FIG. 6) of the short axis direction of the diaphragm 11'. Dotted lines shown in FIG. 8 show a model in the case where no deformation occurs at the time of vibration, and full lines show a model in the case where the deformation occurs at the time of vibration. Portions where a dotted-line model and a full-line model intersect are the positions of the nodes of the resonance mode.

Figure 9:
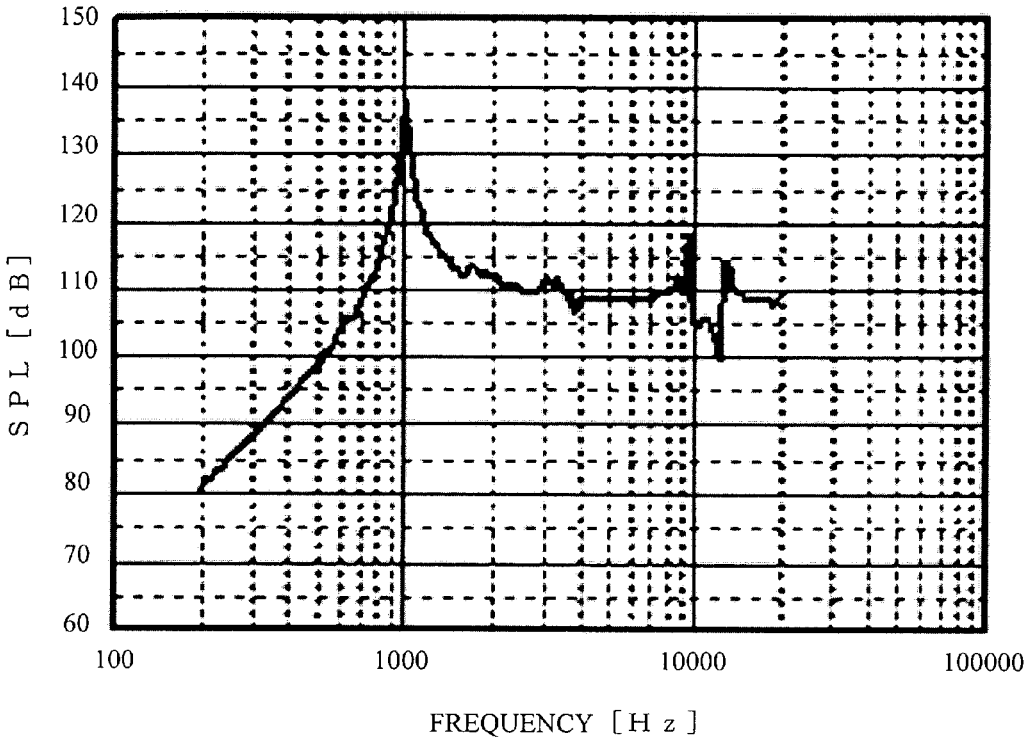
FIG. 9 is a diagram showing a calculation result of the sound pressure/frequency characteristic depending on the variation in the driving point.

In embodiment 1, the positions to which the long sides of the voice coils 14 are mounted are set at the positions of the nodes of the primary resonance mode in the short axis direction of the diaphragm 11, whereby the primary resonance mode in the short axis direction is suppressed. FIG. 9 is a diagram showing the sound pressure/frequency characteristic of the loudspeaker in the case where driving positions in the short axis direction of the diaphragm are set at the positions of the nodes of the primary resonance mode in the short axis direction. The characteristic shown in FIG. 9 is a result of calculation based on the finite element method, and in FIG. 9, the driving length in the long axis direction is 90[%] of the length of the long axis direction of the diaphragm. As shown in FIG. 9, the positions of the nodes of the primary resonance mode in the short axis direction of the diaphragm is located at the driving positions on the diaphragm, whereby it is clear that the peak in the vicinity of 2.8 [kHz] (see FIG. 5) is resolved, and the sound pressure/frequency characteristic of the loudspeaker becomes flat.

As above described, in embodiment 1, with respect to the long axis direction, the driving position is set linearly with a length not less than 60% of the length of the diaphragm, and with respect to the short axis direction, the driving positions are set at the positions of the nodes of the primary resonance mode. As a result, the sound pressure/frequency characteristic becomes flat through to a high frequency, which enables the diaphragm to carry on a piston motion through to the high frequency. That is, sound quality can be improved compared to a conventional loudspeaker having an elongated shape.

With regard to an aspect ratio of the diaphragm, in the case where the length of the vertical direction (referred to as long axis direction) is set as 1, it is preferable that the length of a lateral direction is not larger than 0.5. In this case, a primary resonance frequency in the short axis direction is inversely proportional to a square of the primary resonance frequency in the long axis direction. Therefore, in the case where the aspect ratio of the diaphragm is 1 to 0.5, and the primary resonance frequency in the long axis direction is fL1 [Hz], the primary resonance frequency in the short axis direction fS1 equals to 4*fL1. Further, a secondary resonance frequency is 5.4 times of the primary resonance frequency, and thus the secondary resonance frequency fS2 in the short axis direction satisfies an equation 5.4*fS1=5.4*4*fL1=21.6*fL1 [Hz]. Accordingly, in the case where the aspect ratio of the diaphragm is 1 to 0.5, the sound quality can be improved in accordance with above-described embodiment 1, with respect to a band of frequencies up to 21.6 times of the primary resonance frequency in the long axis direction. Further, in the case where the aspect ratio of the diaphragm is 1 to 0.3, an equation fS1=11.1*fL1 [Hz] is satisfied, and consequently a equation fS2=60*fL1 is satisfied. Therefore, in this case, the sound quality can be improved with respect to a band of frequencies up to 60 times of the primary resonance mode in the long axis direction. Accordingly, the effect of the resonance suppression according to the present embodiment increases as the aspect ratio of the diaphragm increases.

Embodiment 2

Figure 10:
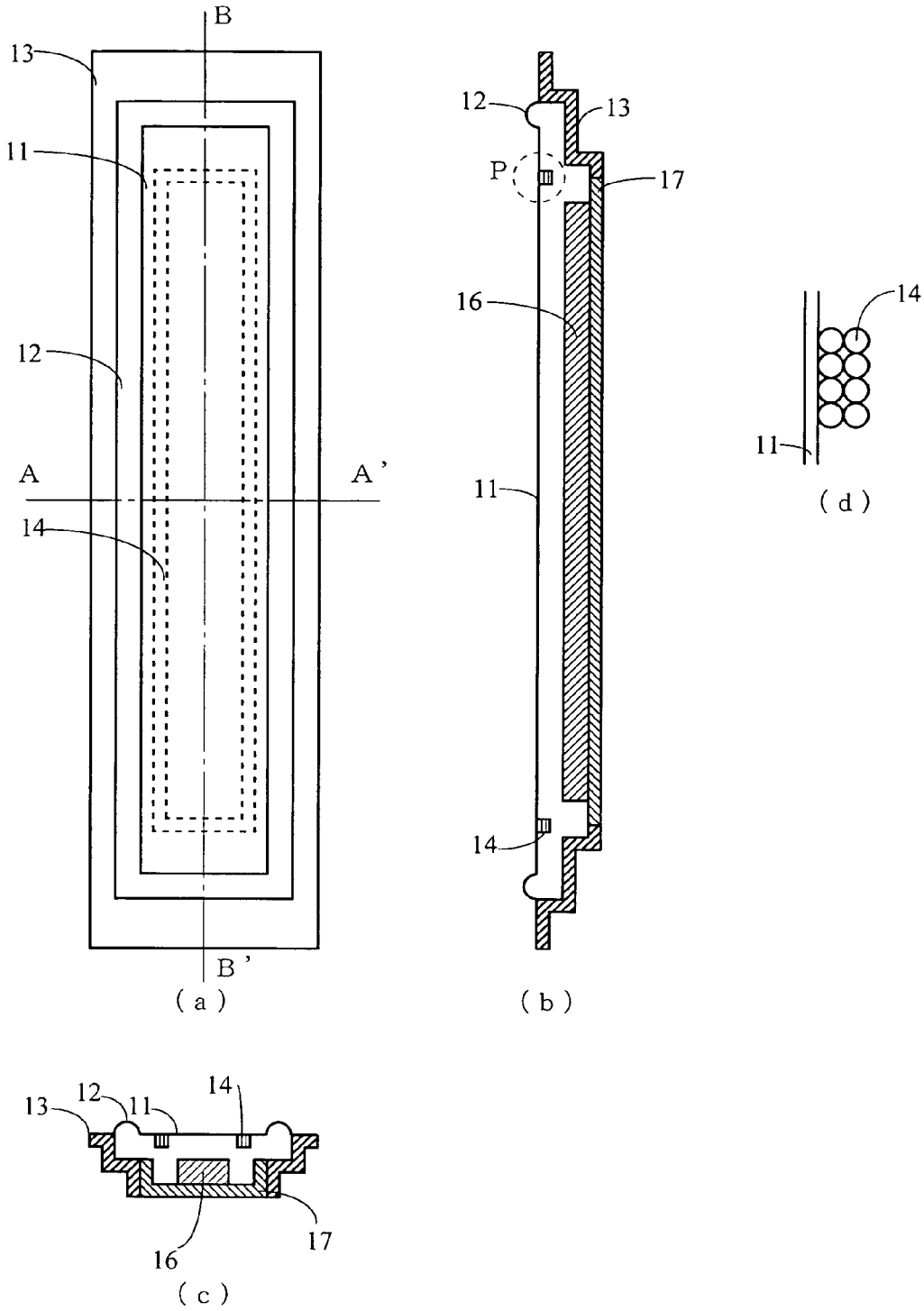
FIG. 10 is a diagram showing a loudspeaker of embodiment 2.

Hereinafter, a loudspeaker according to embodiment 2 will be described. FIG. 10(*a*) is a plan view showing the loudspeaker of embodiment 2, FIG. 10(*b*) is a cross-sectional view (B-B' cross-sectional view) of a long side of the loudspeaker, and FIG. 10(*c*) is a cross-sectional view (A-A' cross-sectional view) of a short side of the loudspeaker. FIG. 10(*d*) is a partially enlarged view of a region P shown in FIG. 10(*b*). With respect to (*a*) to (*d*) of FIG. 10, component elements respectively having identical functions to the component elements shown in (*a*) to (*d*) of FIG. 1 are respectively provided common reference characters. The loudspeaker according to embodiment 2 is different, in that a voice coil 14 thereof is directly connected to a diaphragm 11 thereof, from the loudspeaker according to embodiment 1. Further, the loudspeaker according to embodiment 2 has a magnetic circuit without a top plate 18, which is different from the loudspeaker according to embodiment 1.

As shown in FIG. 10, an outer circumference of the diaphragm 11 is firmly fixed to an inner circumference of an edge 12 having an approximate semicircle cross-section. An opposite side (an outer side) of the edge 12 is firmly fixed to a frame 13. The diaphragm 11 is of a shape extending along a vertical direction, and also of a shape having different lengths of the vertical direction and a lateral direction. In embodiment 2, the voice coil 14 is directly connected to the diaphragm 11. The voice coil 14 is a planar voice coil which is made of a copper or an aluminum wire and winded in a planar manner. Further, in embodiment 2, a magnetic circuit is comprised of a magnet 16 and a yoke 17. Shapes of the magnet 16 and the yoke 17 are the same as those in embodiment 1, respectively. The magnetic circuit is firmly fixed to the frame 13, and generates magnetic flux in space at an upper side of the magnet 16 and the yoke 17. With an application of a driving current, the voice coil 14 generates a driving force which enables the diaphragm 11 to vibrate. The voice coil 14 is of a vertically long rectangle, and is located such that a central axis thereof coincides with that of the diaphragm 11.

Further, a length of a long axis direction of the voice coil 14 is not less than 60% of a length of a long axis direction of the diaphragm 11. The long sides of the voice coil 14 are firmly fixed at positions of nodes of a primary resonance mode in a short axis direction of the diaphragm 11. That is, positions of the long sides of the voice coil 14 to be fixed in the short axis direction are, assuming that the length of the short side of the diaphragm 11 is 1, a position of 0.224 and a position of 0.776 respectively from an extremity of the short axis direction of the diaphragm 11, or respective vicinities thereof. In the case where a constitutional variation such as a shape and a weight of the diaphragm 11 is taken into consideration, assuming that the length of the short axis direction of the diaphragm is 1, a range from 0.2 to 0.25 and a range from 0.75 to 0.8 respectively from the extremity of the short axis direction of the diaphragm 11 are normally optimal fixing positions of the long axis direction of the voice coil 14. In the case where a mass and rigidity of the edge 12 cannot be ignored compared to those of the diaphragm, the positions of the nodes will be slightly different from the above-described positions, and thus the fixing positions are determined depending on the positions of the nodes.

An operation and effects of the loudspeaker constituted as above described will be described. When an electric current is applied to the voice coil 14, the driving force is generated in the voice coil by the applied electric current and a magnetic field caused by the above-described magnetic circuit. With the generated driving force, the diaphragm 11 vibrates, whereby a sound is radiated in space. Here, as with embodiment 1, with respect to the long axis direction of the diaphragm 11, the driving force is applied to a part no less than 60% of the length thereof. Therefore, the same effect as a case where a whole area of the long axis direction of the diaphragm 11 is driven can be obtained. That is, resonance in the long axis direction is suppressed. Further, as with embodiment 1, the driving force is applied to the positions of the nodes of the primary resonance mode in the short axis direction of the diaphragm 11. Therefore, resonance in the short axis direction can be suppressed. Accordingly, as with embodiment 1, a loudspeaker, which has a flat sound pressure/frequency characteristic over a wide range and little distortion, can be realized.

Furthermore, according to embodiment 2, the loudspeaker has a constitution without a voice coil bobbin, and thus a height of the loudspeaker can be lowered compared to embodiment 1. That is, the loudspeaker can be further thinned down. Note that with the use of the magnetic circuit which concentrates a magnetic flux density on a position where the voice coil 14 is located in a concentrated manner, efficiency of an electro-acoustic conversion of the loudspeaker can be improved.

Embodiment 3

Figure 11:
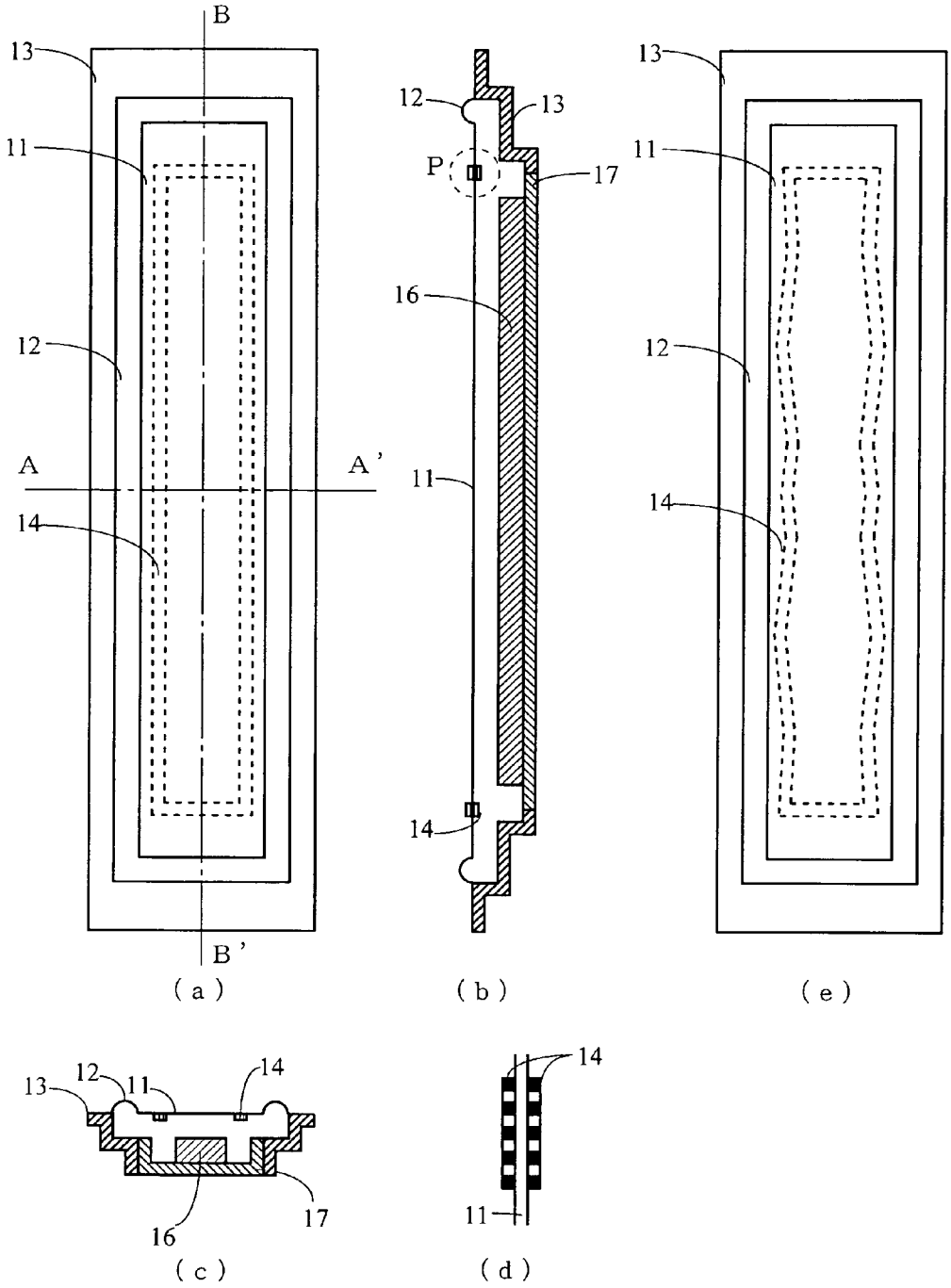
FIG. 11 is a diagram showing a loudspeaker of embodiment 3.

Hereinafter, a loudspeaker according to embodiment 3 will be described. FIG. 11(*a*) is a plan view showing the loudspeaker, FIG. 11(*b*) is a cross-sectional view (B-B' cross-sectional view) of a long side of the loudspeaker, and FIG. 11(*c*) is a cross-sectional view (A-A' cross-sectional view) of a short side of the loudspeaker. FIG. 11(*d*) is a partially enlarged view of a region P shown in FIG. 11(*b*). Further, FIG. 11(*e*) is a diagram showing a different shape of a voice coil. Note that, in (*a*) to (*c*) of FIG. 11, component elements respectively having identical functions to the component elements shown in (*a*) to (*d*) of FIG. 1 are respectively provided common reference characters. The loudspeaker according to embodiment 3 is different, in that a voice coil 14 thereof is a printed coil, from the loudspeaker according to embodiment 2.

As shown in (*a*) to (*c*) of FIG. 11, an outer circumference of a diaphragm 11 is firmly fixed to an inner circumference side of an edge 12 having an approximate semicircle cross-section. An opposite side (an outer circumference side) of the edge 12 is firmly fixed to a frame 13. The diaphragm 11 is of a shape extending along a vertical direction, and also of a shape having different lengths of the vertical direction and a lateral direction. In embodiment 3, the diaphragm 11 is made of an insulated substrate such as PI, PET, PEN, PEI, PAI, glass epoxy or the like. The voice coil 14 is formed on a substrate which is the diaphragm 11. The voice coil 14 is a printed wiring coil made of copper or aluminum. Further, as with embodiment 2, a magnetic circuit is comprised of a magnet 16 and a yoke 17. Shapes of the magnet 16 and the yoke 17 are the same respectively as those in embodiment 1. The magnetic circuit is firmly fixed to the frame 13, and generates magnetic flux in space at an upper side of the magnet 16 and the yoke 17. With an application of a driving current, the voice coil 14 generates a driving force which enables the diaphragm 11 to vibrate. The voice coil 14 is of a vertically long rectangle, and is located such that a central axis thereof coincides with that of the diaphragm 11.

Further, a length of a long axis direction of the voice coil 14 is not less than 60% of a length of a long axis direction of the diaphragm 11. The long sides of the voice coil 14 are located at positions of nodes of primary resonance mode in a short axis direction of the diaphragm 11. That is, assuming that a length of the short axis direction is 1, positions of the long sides of the voice coil 14 to be located in the short axis direction are a position of 0.224 and a position of 0.776 respectively from an extremity of the short side of the diaphragm 11, or respective vicinities thereof. In the case where a constitutional variation such as a shape and a weight of the diaphragm 11 is taken into consideration, assuming that the length of the short axis direction of the diaphragm is 1, a range from 0.2 to 0.25 and a range from 0.75 to 0.8 respectively from the extremity of the short axis direction of the diaphragm 11 are normally optimal locating positions of the long axis direction of the voice coil 14. In the case a mass and rigidity of the edge 12 cannot be ignored compared to those of the diaphragm, the positions of the nodes will be slightly different from the above-described positions, and thus the locating positions are determined depending on the positions of the nodes.

An operation and effects of the loudspeaker constituted as above described will be described. When an electric current is applied to the voice coil 14, a driving force is generated in the voice coil 14 due to the applied electric current and a magnetic field cause by the above-described magnetic circuit. With the generated driving force, the diaphragm 11 vibrates, whereby a sound is radiated in space. Here, as with embodiment 1, with respect to the long axis direction of the diaphragm 11, the driving force is applied to a part no less than 60% of the length thereof. Therefore, in the long axis direction, the same effect as a case where a whole area of the long axis direction of the diaphragm 11 is driven can be obtained. That is, resonance in the long axis direction is suppressed. Further, as with embodiment 1, the driving force is applied to the positions of the nodes of the primary resonance mode in the short axis direction of the diaphragm 11. Therefore, resonance in the short axis direction can be suppressed. Accordingly, as with embodiment 1, a loudspeaker, which has a flat sound pressure/frequency characteristic over a wide range and also has little distortion, can be realized. Further, as with embodiment 2, due to a constitution without a voice coil bobbin, a thinner loudspeaker can be realized compared to embodiment 1. Note that, with the use of the magnetic circuit which concentrates a magnetic flux density on a position where the voice coil 14 is located in a concentrated manner, efficiency of an electro-acoustic conversion of the loudspeaker can be improved.

Further, according to embodiment 3, the voice coil 14 is formed on the diaphragm 11 with the use of a printed wiring technology, whereby the voice coil 14 can be located at a more precise position compared to a case where a coil made of a wire is bonded to the diaphragm. By locating the voice coil 14 at the more precise position, a high sound quality loudspeaker can be realized.

In embodiment 3, although a long side of the printed coil is in a straight line, the long side of the printed coil may be formed in a polygonal line or a curved line (see FIG. 11(*d*)). That is, the long side of the printed coil may be comprised of a polygonal line or a curved line which includes a component of the short axis direction. Accordingly, a range to which the driving force is applied on the diaphragm 11 can be broadened in the short axis direction, whereby the driving force can be assuredly applied to the positions of the nodes of the primary resonance mode in the short axis direction. As shown in FIG. 11(*e*), the printed coils are preferably formed on both sides of the diaphragm 11. That is, the printed coils are preferably symmetrical with respect to a center of a thickness of the diaphragm 11.

Embodiment 4

Figure 12:
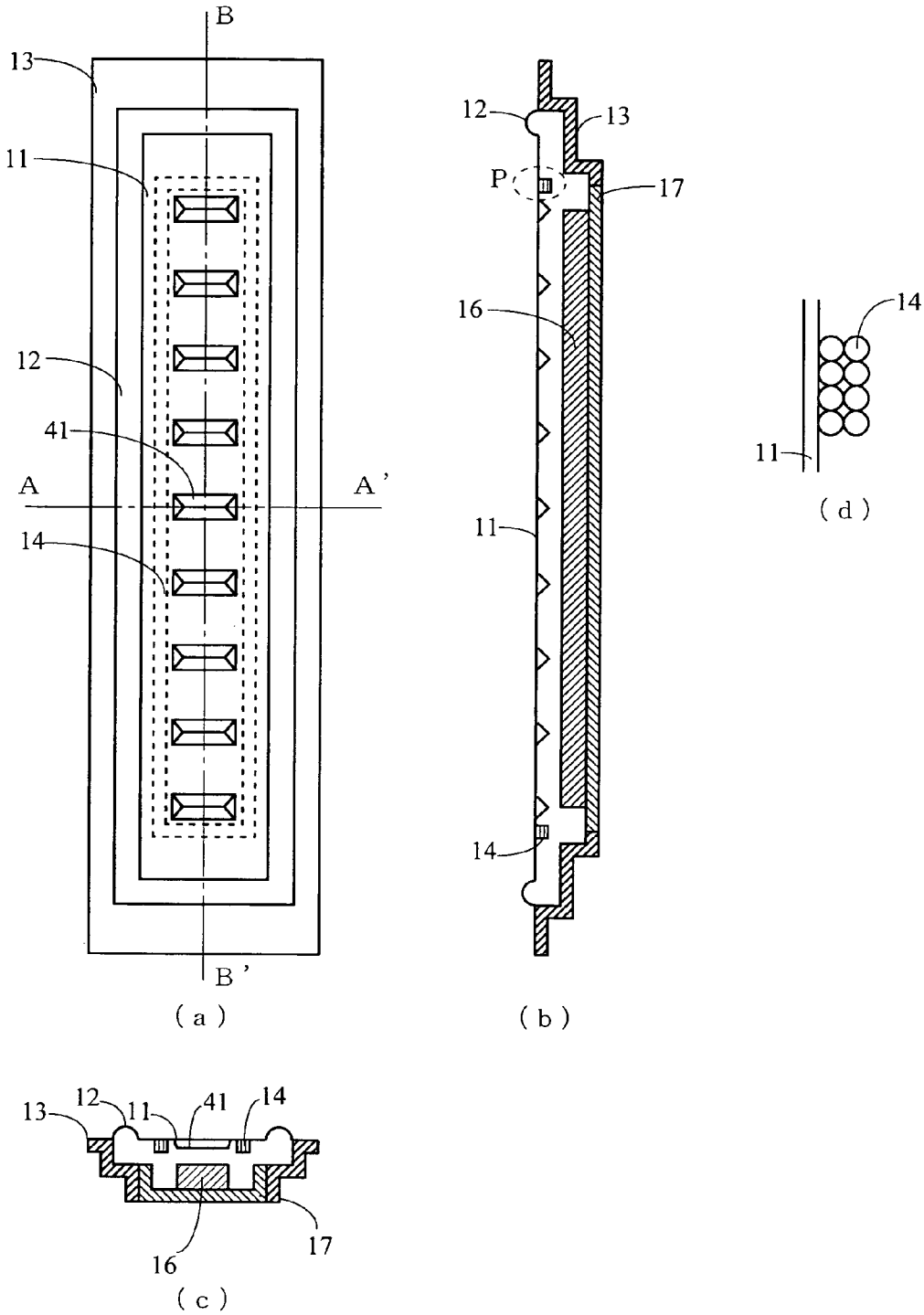
FIG. 12 is a diagram showing a loudspeaker of embodiment 4.

Hereinafter, a loudspeaker according to embodiment 4 will be described. FIG. 12(*a*) is a plan view of the loudspeaker, FIG. 12(*b*) is a cross-sectional view (B-B' cross-sectional view) of a long side of the loudspeaker, and FIG. 12(*c*) is a cross-sectional view (A-A' cross-sectional view) of a short side of the loudspeaker. FIG. 12(*d*) is a partially enlarged view of a region P shown in FIG. 12(*b*). In (*a*) to (*d*) of FIG. 12, component elements respectively having identical functions to the component elements shown in (*a*) to (*d*) of FIG. 1 are respectively provided common reference characters. The loudspeaker according to embodiment 4 is different, in that ribs are provided thereto, from the loudspeaker according to embodiment 2. Since other points are similar to embodiment 2, differences between embodiment 2 and embodiment 4 will be mainly described hereinafter.

Figure 13:
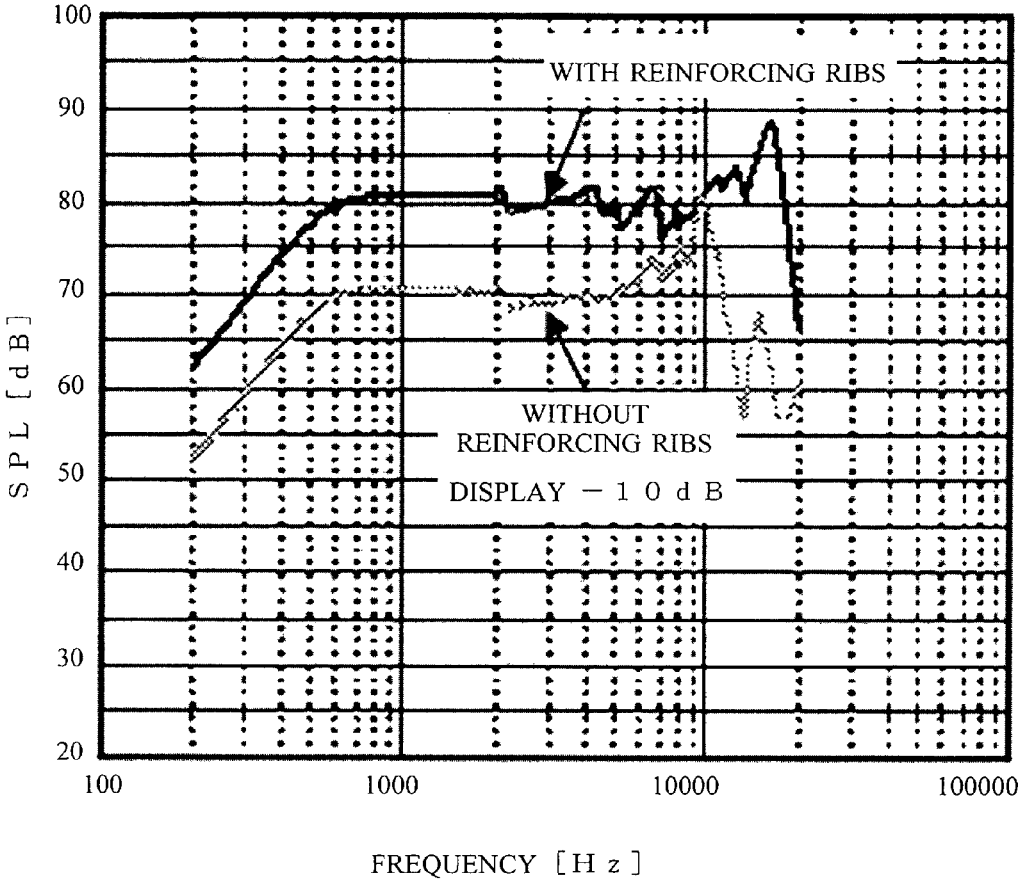
FIG. 13 is a diagram showing the sound pressure/frequency characteristic in the cases of without and with reinforcing ribs.

In embodiment 4, a plurality of reinforcing ribs 41 is provided to an inner circumference side of a portion where voice coil 14 is bonded to on a diaphragm 11. The reinforcing ribs 41 provide the diaphragm 11 with convexoconcaves. In FIG. 12, each of the reinforcing ribs 41 extends in a short axis direction, and each of the reinforcing ribs 41 is located parallel to one another. With provision of the reinforcing ribs 41 to the diaphragm 11, a bending strength thereof can be increased compared to a planar diaphragm. The bending strength of the short axis direction of the diaphragm 11 is increased, whereby a resonance frequency of a resonance mode in the short axis direction can be raised. FIG. 13 is a diagram showing a calculation result, based on a finite element method, of a sound pressure/frequency characteristic of cases without and with the reinforcing ribs. In FIG. 13, a characteristic illustrated with a thin line is the sound pressure/frequency characteristic of the case without the reinforcing ribs, and a characteristic illustrated with a bold line is the sound pressure/frequency characteristic of the case with the reinforcing ribs. As shown in FIG. 13, a peak of the sound pressure/frequency characteristic, which is at 10 [kHz] in the case without the reinforcing ribs, increases to 17 [kHz] in the case with the reinforcing ribs. That is, with provision of the reinforcing ribs, the diaphragm 11 carries on a motion similar to a piston motion through to an even high frequency band, whereby a loudspeaker capable of wideband reproduction can be provided.

Note that the reinforcing ribs may be provided to the diaphragm in other embodiments than embodiment 2. Further, the ribs (tangential ribs) may be also provided to an edge portion.

Figure 14:
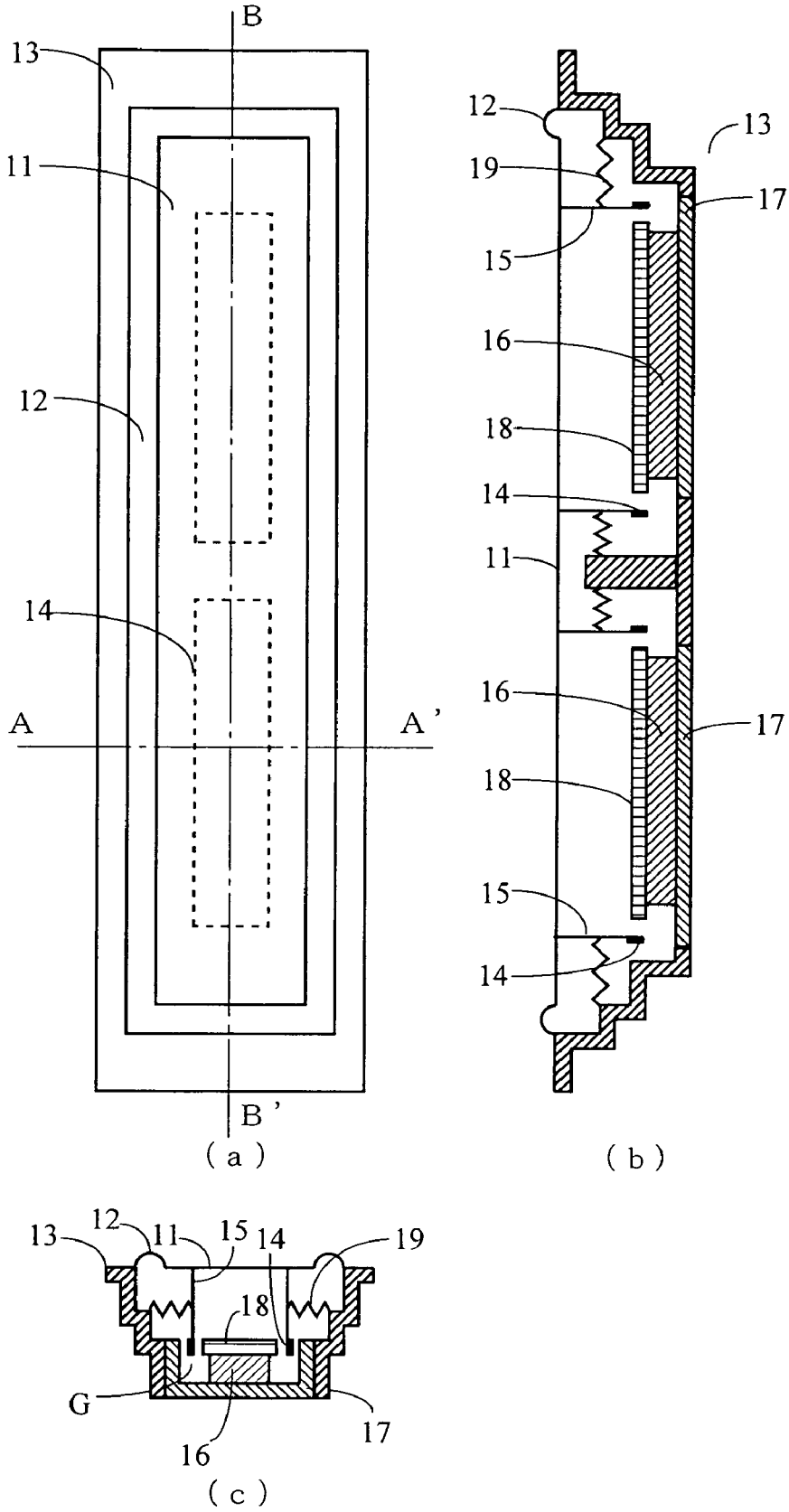
FIG. 14 is a diagram showing a loudspeaker of a different embodiment.
Figure 15:
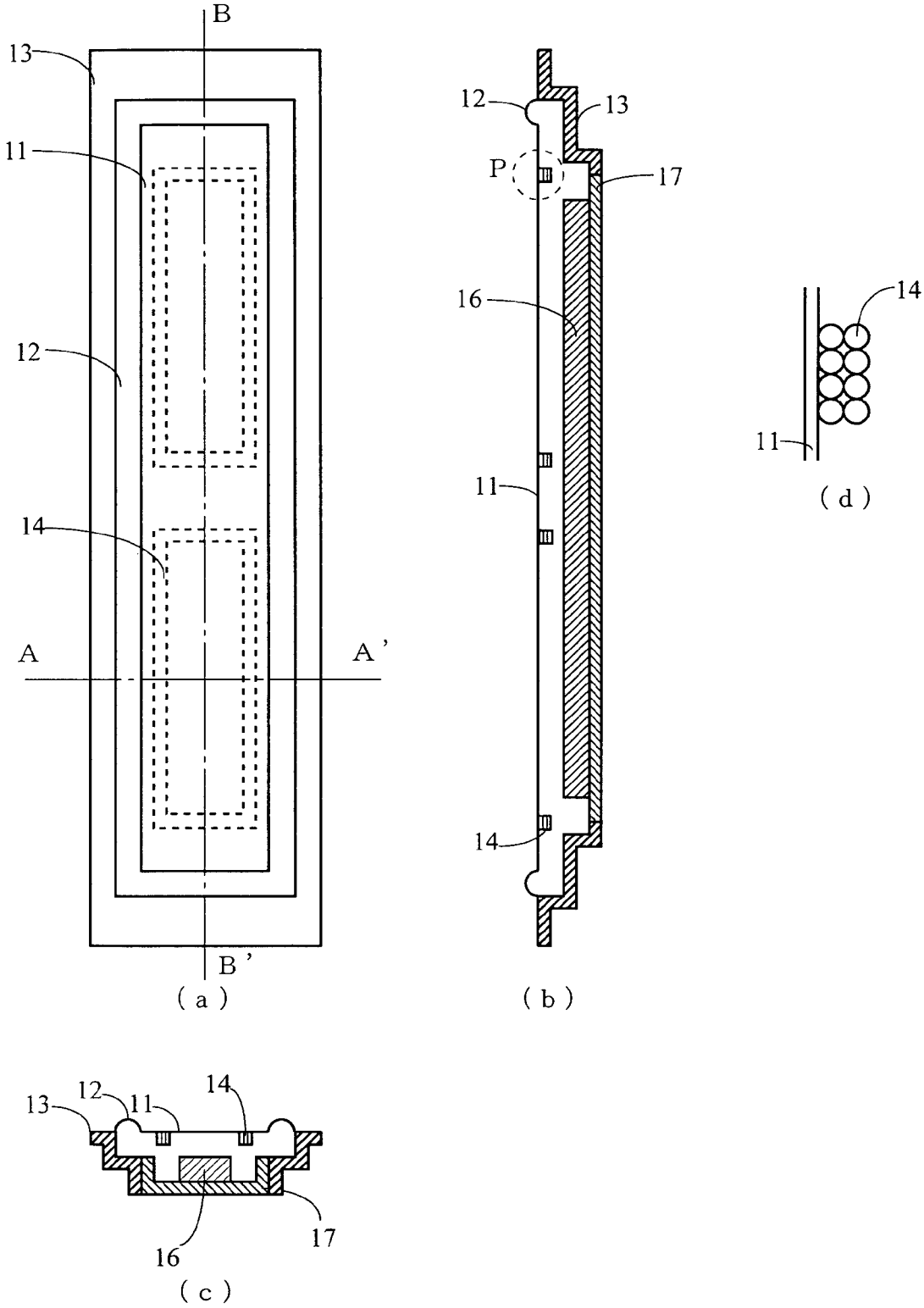
FIG. 15 is a diagram showing a loudspeaker of a different embodiment.

Further, in each of above-described embodiments 1 to 4, a plurality of voice coils may be located in a long axis direction. FIG. 14 is a diagram showing an example of a deformation of the loudspeaker according to embodiment 1. Further, FIG. 15 is a diagram showing an example of a deformation of the loudspeaker according to embodiment 2. As shown in FIGS. 14 and 15, a plurality (two in FIGS. 14 and 15, respectively) of voice coils may be arranged in the long axis direction. Here, a total length of long axis directions of the respective voice coils may be no less than 60% of the length of the long axis direction of the diaphragm 11.

Embodiment 5

Figure 16:
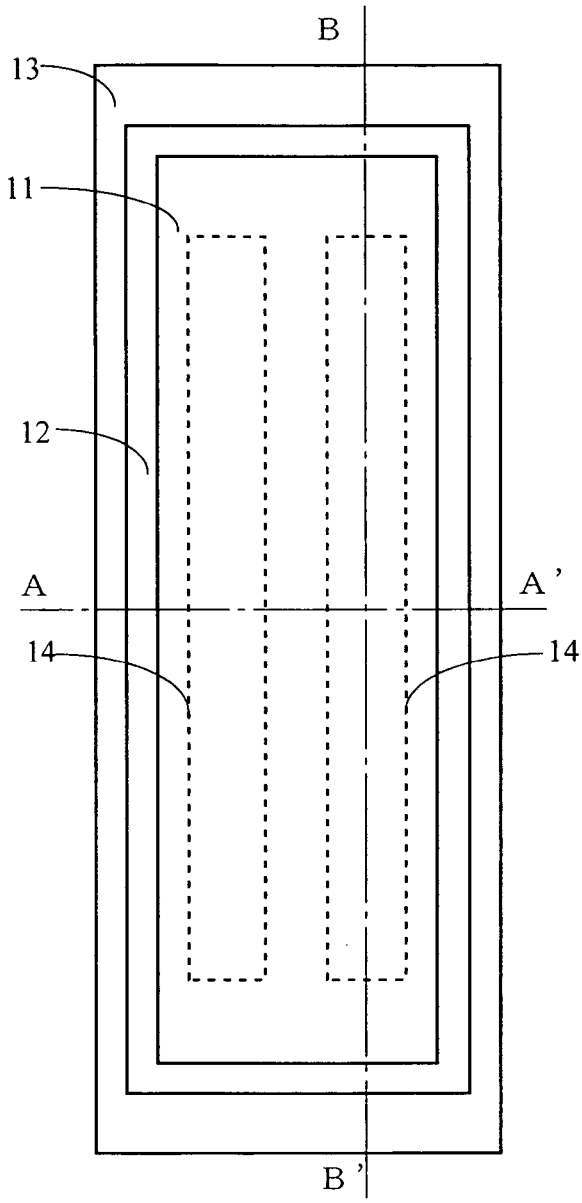
FIG. 16 is a diagram showing a loudspeaker of embodiment 5.
Figure 16:
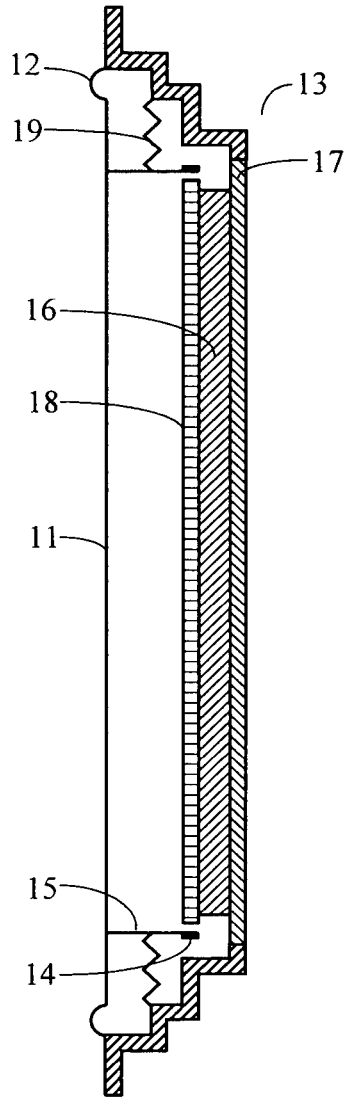
Figure 16:
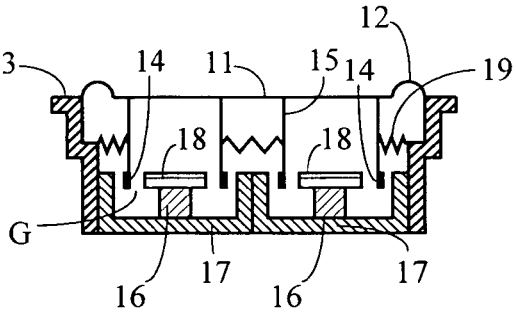

Hereinafter, a loudspeaker according to embodiment 5 will be described. FIG. 16(*a*) is a plan view of the loudspeaker according to embodiment 5. FIG. 16(*b*) is a cross-sectional view (B-B' cross-sectional view) of a long side of the loudspeaker, and FIG. 16(*c*) is a cross-sectional view (A-A' cross-sectional view) of a short side of the loudspeaker. The loudspeaker according to embodiment 5 suppresses first and second resonance modes in a short axis direction, and is thus different from the loudspeaker according to embodiment 1.

In (*a*) to (*c*) of FIG. 16, a diaphragm 11 is rectangular planar. Further, an edge 12 is of a ring shape having an approximate semicircle cross-section. An outer circumference of the diaphragm 11 is firmly fixed to an inner circumference of the edge 12. A frame 13 is of a ring shape having an opening portion. An outer circumference of the edge 12 is firmly fixed to the opening portion of the frame 13. As shown in FIG. 16(*a*), the diaphragm 11 is of an elongated shape having different lengths of a vertical direction and a lateral direction.

A magnetic circuit is comprised of a magnet 16, a yoke 17, and a top plate 18, and generates magnetic flux in a magnetic gap G. In FIG. 16, the loudspeaker has two of the magnetic circuits. The two magnetic circuits are located in line in the short axis direction. As with the diaphragm 11, the magnet 16, the yoke 17, and the top plate 18 also have rectangular shapes, respectively, when looked from a upper surface (a surface at an upper side of FIG. 1(*c*)). The yoke 17 has a shape such that a cross-section thereof comprises three sides of a rectangle (block C shape) when looked from the long axis direction, and also has a bottom surface, and side surfaces in the long axis direction. The yoke 17 does not have side surfaces in the short axis direction. Therefore, the magnetic gap G is formed between a long side of the rectangular top plate 18 and the side surfaces of the yoke 17. The above-described magnetic circuit is firmly fixed to the frame 13.

On the other hand, two tubular-shaped voice coil bobbins 15 are firmly fixed on the diaphragm 11. Each of the voice coil bobbins 15 has a rectangle shape when looked from the upper surface. The two voice coil bobbins 15 are located in a symmetrical manner with respect to a central line (a central line extending in a long axis direction) of a short axis direction of the diaphragm 11. Long sides of each of the voice coil bobbin 15 and the diaphragm 11 is located in an approximate parallel manner. Voice coils 14 are respectively winded around the respective voice coil bobbins 15. That is, each of the voice coils 14 is fixed to the diaphragm 11 via each of the voice coil bobbins 15. Each of the voice coil bobbins 15 is connected to the frame 13 via a suspension 19. Therefore, each of the voice coil 14 is enabled to vibrate by the suspension 19 and an edge 12. Each of the voice coil 14 is supported by each of the voice coil bobbin 15 such that each of the voice coil 14 is located within the magnetic gap G. Accordingly, an electric current is applied to each of the voice coils 14, whereby a driving force is generated in each of the voice coils 14.

As with embodiment 1, a length of a long axis direction of each of the voice coil bobbins 15 is no less than 60% of a length of a long axis direction of the diaphragm 11. That is, each of the voice coil bobbins 15 is fixed to a part no less than 60% of the long axis direction of the diaphragm 11.

Further, in embodiment 5, positions of the long sides of each of the voice coil bobbins 15 to be fixed to in the short axis direction are positions where both of primary resonance and secondary resonance in the short axis direction of the diaphragm 11 are suppressed. Therefore, the diaphragm 11 is driven such that, with respect to the long axis direction, a whole area thereof is driven, and, with respect to the short axis direction, both of a primary resonance mode and a secondary resonance mode are suppressed.

Specifically, with regard to one voice coil bobbin of the two voice coil bobbins 15, assuming that a length of a short side of the diaphragm 11 is 1, one long side thereof is fixed to a position corresponding to 0.113 from an extremity of the short side of the diaphragm 11, and another long side thereof is fixed to a position corresponding to 0.37775. In the case where a constitutional variation such as a shape and a weight of the diaphragm 11 is taken into consideration, a range from 0.1 to 0.15 and a range from 0.35 to 0.4 with respect to the short axis direction of the diaphragm 11 are normally optimal as positions of the long sides of the one voice coil bobbin 15 to be mounted to the diaphragm 11. Further, with respect to another voice coil bobbin 15, one long side thereof is fixed to a position corresponding to 0.62225 from the extremity of the short side of the diaphragm 11, and another long side thereof is fixed to a position corresponding to 0.887. In the case where the constitutional variation such as the shape and the weight of the diaphragm 11 is taken into consideration, a range from 0.6 to 0.65 and a range from 0.85 to 0.9 with respect to the short axis direction of the diaphragm 11 are normally optimal as the positions of the long sides of said another voice coil bobbin 15 to be mounted to the diaphragm 11.

In the case where a mass and rigidity of the edge 12 cannot be ignored compared to those of the diaphragm 11, positions of nodes of the primary and secondary resonance modes on the diaphragm 11 will change from the above-described positions, and thus fixing positions of the voice coils 14 (voice coil bobbins 15) require to be moved depending on the positions of the nodes.

An operation and effects of the loudspeaker constituted as above described will be described. When an electric current is applied to each of the voice coils 14, the driving force is generated in each of the voice coils by the applied electric current and a magnetic field caused by each of the above-described magnetic circuits. With the generated driving force, the diaphragm 11 vibrates, whereby a sound is radiated in space. A single signal is applied to two of the voice coils 14. Here, according to the loudspeaker of embodiment 5, positions (i.e. the fixing positions of the voice coil bobbins 15) where the driving force is provided on the diaphragm 11 are set at the above-described positions, whereby resonance of the diaphragm 11 can be suppressed. In embodiment 5, the primary resonance and the secondary resonance in the short axis direction can be suppressed.

Hereinafter, a calculation method will be described in relation to positions of the long sides of the voice coil bobbins to be fixed to in the short axis direction of the diaphragm 11. Assuming that the length of the short side of the diaphragm 11 is 1, the positions of the nodes of the resonance modes in the short axis direction of the diaphragm 1 will be as follows. That is, the positions of the nodes of the primary resonance mode are, as above described, positions of 0.224 and 0.776 from the extremity of the short side of the diaphragm 11. Further, the positions of the nodes of the secondary resonance mode are positions of 0.0944, 0.356, 0.644, and 0.9066 from the extremity of the short side of the diaphragm 11.

Here, in the case where voice coils 14 are firmly fixed to the positions of the nodes of the secondary resonance mode, the secondary resonance mode can be suppressed. However, in the case where the voice coils 14 are fixed to the nodes of the secondary resonance mode, the secondary resonance mode will be eliminated, whereas the primary resonance mode will not be eliminated completely (although the primary resonance mode will be suppressed compared to a central driving). The reason is that, in this case, with respect to the primary resonance mode, powers to be acted equivalently on insides and outsides of the nodes of the mode will not become equal. Therefore, to eliminate both of the primary and the secondary resonance modes, driving points where neither of the modes will occur require to be figured out. Details will be described hereinafter.

When only the short axis direction is focused on, the resonance mode of the diaphragm 11 can be regarded as a resonance mode of a bar having both free ends. Therefore, a forced vibrational displacement $\xi$ caused by a concentrated driving force $Fx*e^{j\omega t}$ is provided by equation (1), $$\xi = \frac{F_x}{\rho s l}\sum_m \frac{1}{\omega_m^2 - \omega^2}\cdot \Xi_m(x)\cdot \Xi_m(y)\cdot e^{j\omega t} \tag{1}$$

wherein, $\rho$: density s: cross-sectional area of bar l: length of bar $\Xi m(x)$, $\Xi m(y)$: normal mode function showing vibration mode $\omega$: angular rate.

Next, assuming that the length of the short side of the diaphragm 11 is 1, the vibrational displacement $\xi$ in the case where four points of x1, x2, x3, and x4 from the extremity of the short side are driven is provided by equation (2).

$$\xi = \frac{1}{\rho s l}\sum_m \frac{1}{\omega_m^2 - \omega^2} \{F_{x1}\Xi_m(x1) + F_{x2}\Xi_m(x2) + F_{x3}\Xi_m(x3) + F_{x4}\Xi_m(x4)\}\Xi_m(y)\cdot e^{j\omega t} \tag{2}$$

Here, a condition where the primary resonance mode and the secondary resonance mode do not occur is that x1, x2, x3, and x4 satisfy equation (3). (Due to symmetric driving with respect to a center, an asymmetric mode will not occur. Therefore, with the exclusion of the asymmetric mode, here, referred to as primary resonance mode and secondary resonance mode in order of an increasing mode number.) That is, as driving points suppressing the primary and the secondary resonance, x1, x2, x3, and x4 all of which satisfy equation (3) may be figured out.

$$\{F_{x1}\Xi_m(x1)+F_{x2}\Xi_m(x2)+F_{x3}\Xi_m(x3)+F_{x4}\Xi_m(x4)\}=0 \quad (3)$$

Here, due to the symmetrical driving with respect to the center in equal powers, equation (4) below is satisfied.

$$F_{x1}=F_{x2}=F_{x3}=F_{x4}=F_x \quad (4)$$

Therefore, the condition to satisfy equation (3) may be expressed as equation (5) and equation (6).

$$\Xi_1(x1)+\Xi_1(x2)+\Xi_1(1-x2)+\Xi_1(1-x1)=0 \quad (5)$$

$$\Xi_2(x1)+\Xi_2(x2)+\Xi_2(1-x2)+\Xi_2(1-x1)=0 \quad (6)$$

When the driving point x is figured out so as to satisfy equation (5) and equation (6) simultaneously, equation (7) as below is provided.

$$X1=0.1130$$

$$X2=0.37775$$

$$X3=(1-x2)=0.62225$$

$$X4=(1-x1)=0.8770 \quad (7)$$

Accordingly, four points satisfying equation (7) as indicated as x1 to x4 may be driving points. In embodiment 5, since positions expressed in equation (7) are driven, the primary and the secondary resonance modes will not occur. Therefore, according to embodiment 5, since the secondary resonance mode can be suppressed in addition to the primary resonance mode, a region of a piston motion in the diaphragm is further expanded, and a sound pressure/frequency characteristic becomes flat. Therefore, a high quality loudspeaker can be realized.

Embodiment 6

Figure 17:
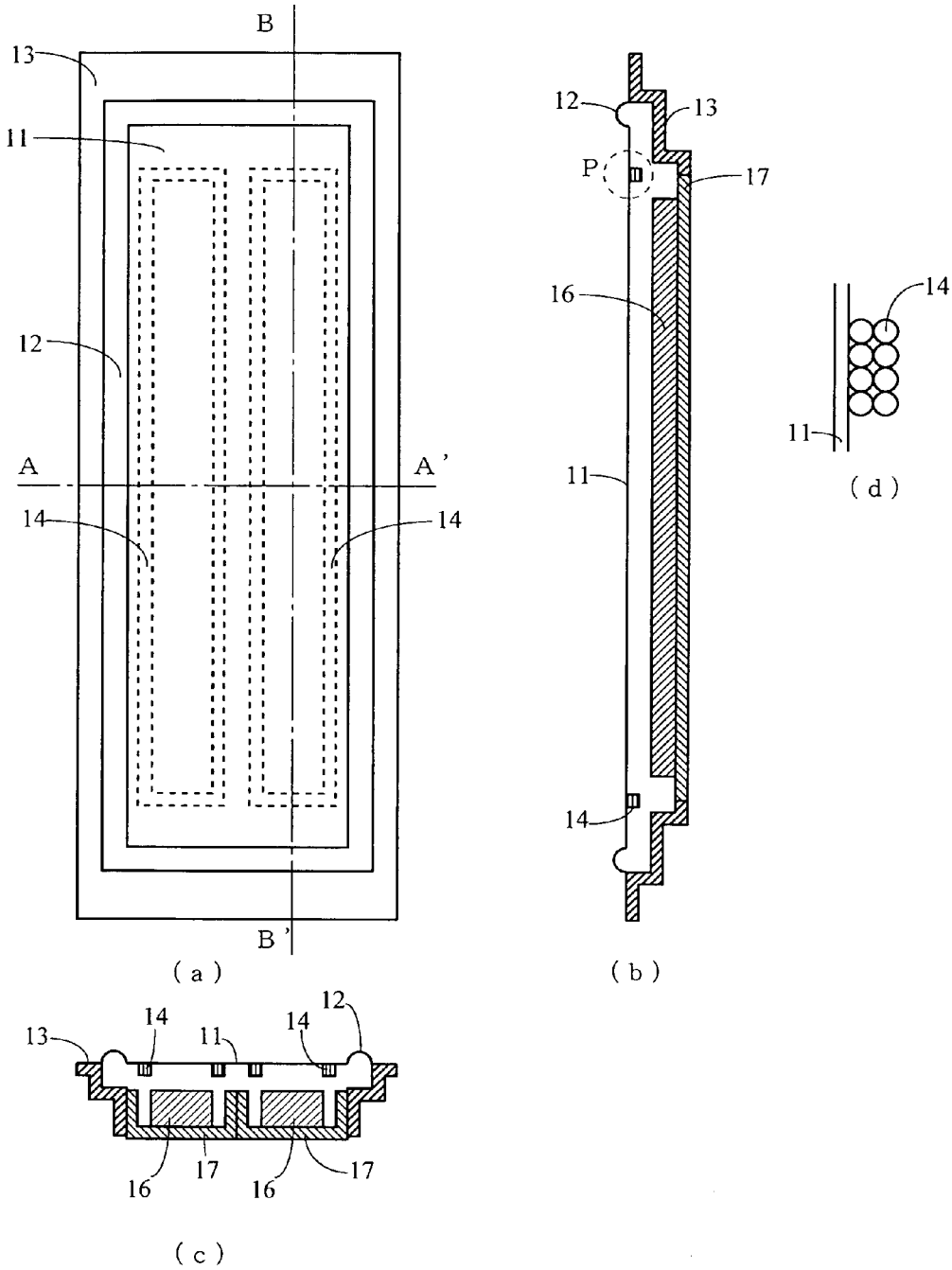
FIG. 17 is a diagram showing a loudspeaker of embodiment 6.

Hereinafter, a loudspeaker according to embodiment 6 will be described. FIG. 17(*a*) is a plan view showing the loudspeaker, FIG. 17(*b*) is a cross-sectional view (B-B' cross-sectional view) of a long side of the loudspeaker, and FIG. 17(*c*) is a cross-sectional view (A-A' cross-sectional view) of a short side of the loudspeaker. FIG. 17(*d*) is a partially enlarged view of a region P shown in FIG. 17(*b*). Note that, in (*a*) to (*d*) of FIG. 17, component elements respectively having identical functions to the component elements shown in (*a*) to (*d*) of FIG. 1 are respectively provided common reference characters. The loudspeaker according to embodiment 6 is different, in that voice coils 14 are respectively connected to a diaphragm 11 directly, from the loudspeaker according to embodiment 5. Further, the loudspeaker according to embodiment 6 is different, in that magnetic circuits without top plates 18 are provided, from the loudspeaker according to embodiment 5.

As shown in FIG. 17, an outer circumference of the diaphragm 11 is firmly fixed to an inner circumference of an edge 12 having an approximately semicircle cross-section. An opposite side (an outer circumference side) of the edge 12 is firmly fixed to a frame 13. The diaphragm 11 is of a shape extending along a vertical direction, and also of a shape having different lengths of the vertical direction and a lateral direction. In embodiment 6, each of the voice coils 14 is directly connected to the diaphragm 11. Each of the voice coils 14 is a planar voice coil which is made of a copper or an aluminum wire and winded in a planar manner. Further, in embodiment 6, each of the magnetic circuits is comprised of a magnet 16 and a yoke 17. Shapes of the magnet 16 and the yoke are the same as those in embodiment 5. Each of the magnetic circuit is firmly fixed to a frame 13, and generates magnetic flux in space at an upper side of the magnet 16 and the yoke 17. With an application of a driving current, each of the voice coils 14 generates a driving force which enables the diaphragm 11 to vibrate.

Further, a length of a long axis direction of each of the voice coils 14 is, as with embodiment 5, not less than 60% of a length of a long axis direction of the diaphragm 11. On the other hand, positions of long sides of voice coils 14 to be fixed to on the diaphragm 11 in a short axis direction are, as with embodiment 5, positions where both of primary resonance and secondary resonance in the short axis direction of the diaphragm 11 are suppressed. Specifically, with regard to one voice coil 14 of the two voice coils 14, assuming that a length of a short side of the diagram is 1, one of the long sides thereof is firmly fixed to a position corresponding to 0.113 from an extremity of the short side of the diaphragm 11, and another long side thereof is firmly fixed to a position corresponding to 0.37775. In the case where a constitutional variation such as a shape and a weight of the diaphragm 11 is taken into consideration, a range from 0.1 to 0.15 and a range from 0.35 to 0.4 in the short axis direction of the diaphragm 11 are normally optimal as positions of the long sides of the one voice coil 14 to be mounted on the diaphragm 11. Further, with respect to another voice coil 14, one long side thereof is firmly fixed to a position corresponding to 0.62225 from the extremity of the short side of the diaphragm 11, and another long side thereof is firmly fixed to a position corresponding to 0.887. In consideration of the constitutional variation such as the shape and the weight of the diaphragm 11, a range from 0.6 to 0.65 and a range from 0.85 to 0.9 in the short axis direction of the diaphragm 11 are normally optimal as positions of the long sides of said another voice coil 14 to be fixed on the diaphragm 11. Note that in the case where a mass and rigidity of the edge 12 cannot be ignored compared to those of the diaphragm 11, positions of nodes of primary and secondary resonance modes will change from the above-described positions, and thus the positions of the voice coils 14 to be fixed to require to be changed depending on the positions of the respective nodes.

An operation and effects of the loudspeaker constituted as above described will be described. When an electric current is applied to each of the voice coils 14, a driving force is generated in each of the voice coils 14 by the applied electric current and a magnetic field caused by each of the above-described magnetic circuits. With the generated driving force, the diaphragm 11 vibrates, whereby a sound is radiated in space. Here, as with embodiment 1, with regard to the long axis direction of the diaphragm 11, the driving force is applied to no less than 60% of the length thereof. Therefore, the same effect as a case where a whole area of the diaphragm 11 in the long axis direction is driven can be obtained. That is, resonance in the long axis direction can be suppressed. Further, as with embodiment 5, the long sides of each of the voice coils 14 are fixed to positions, with respect to the short axis direction, where both of the primary resonance and the secondary resonance in the short axis direction of the diaphragm are suppressed. Therefore, the resonance in the short axis direction can be suppressed. Accordingly, as with embodiment 5, a loudspeaker which has a flat sound pressure/frequency characteristic over a wide range and also has little distortion can be realized.

Further, according to embodiment 6, the loudspeaker has a constitution without the voice coil bobbins, and thus a height of the loudspeaker can be lowered compared to embodiment 1. That is, the loudspeaker can be further thinned down. Note that with the use of each of the magnetic circuits which concentrates a magnetic flux density on a position where each of the voice coils 14 are located in a concentrated manner, efficiency of an electro-acoustic conversion of the loudspeaker can be improved.

Embodiment 7

Figure 18:
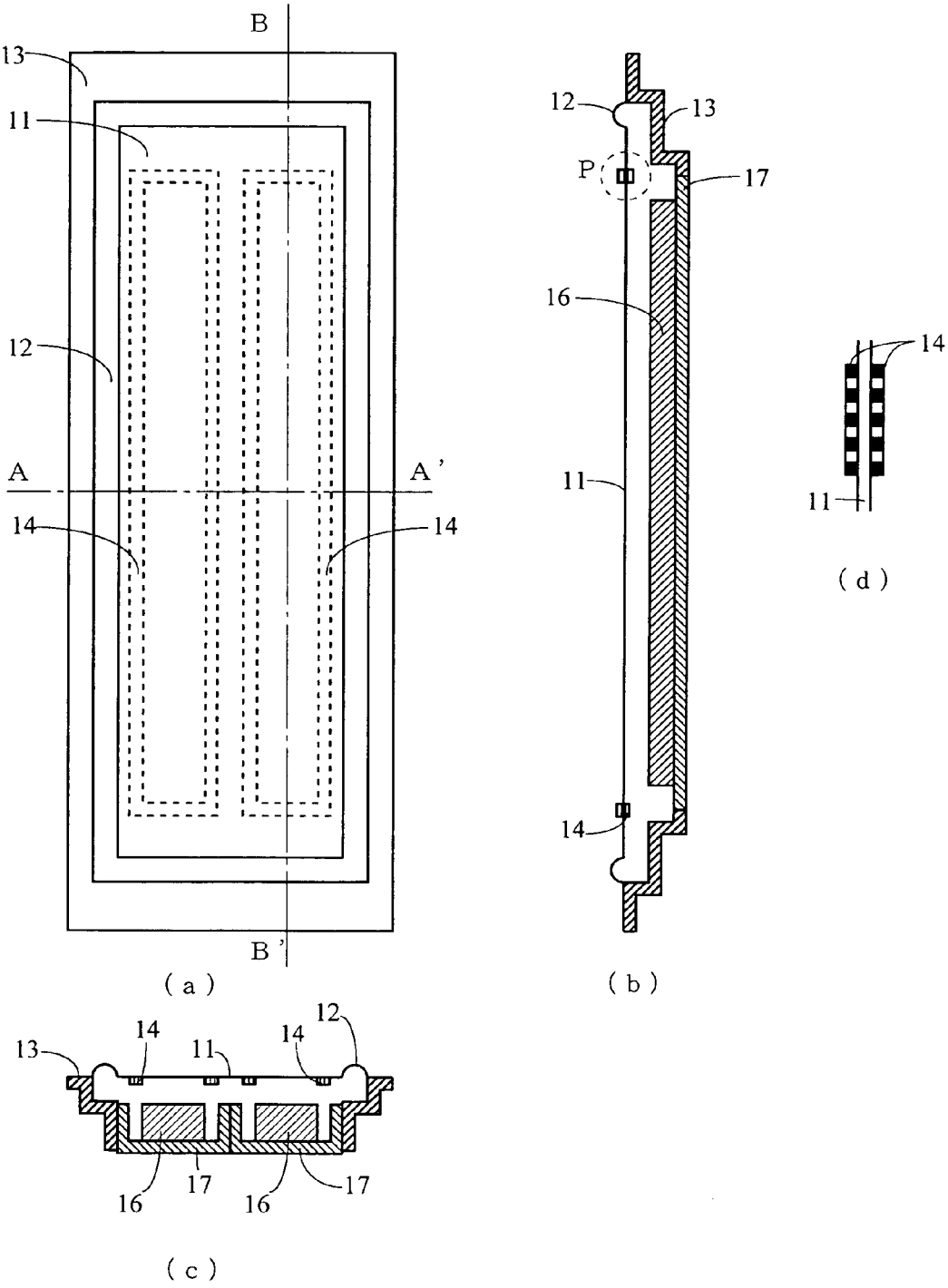
FIG. 18 is a diagram showing a loudspeaker of embodiment 7.

Hereinafter, a loudspeaker according to embodiment 7 will be described. FIG. 18(*a*) is a plan view showing the loudspeaker, FIG. 18(*b*) is a cross-sectional view (B-B' cross sectional view) of a long side of the loudspeaker, and FIG. 18(*c*) is a cross sectional view (A-A' cross sectional view) of a short side of the loudspeaker. FIG. 18(*d*) is a partially enlarged view of a region P shown in FIG. 18(*b*). In (*a*) to (*d*) of FIG. 18, component elements respectively having identical functions to the component elements shown in (*a*) to (*d*) of FIG. 1 are respectively provided common reference characters. The loudspeaker according to embodiment 7 is different, in that voice coils 14 thereof are printed coils, from the loudspeaker according to embodiment 6.

As shown in (*a*) to (*c*) of FIG. 18, an outer circumference of a diaphragm 11 is firmly fixed to an inner circumference of an edge 12 having an approximate semicircle cross-section. An opposite side (an outer circumference side) of the edge 12 is firmly fixed to a frame 13. The diaphragm 11 is of a shape extending along a vertical direction, and is also of a shape having different lengths of the vertical direction and a lateral direction. In embodiment 7, the diaphragm 11 is made of an insulated substrate such as PI, PET, PEN, PEI, PAI, and glass epoxy or the like. Each of the voice coils 14 is formed on a substrate which is the diaphragm 11. Each of the voice coils 14 is a printed wiring coil made of copper or aluminum. Further, as with embodiment 6, magnetic circuits are respectively comprised of magnets 16 and a yokes 17. Shapes of the magnets 16 and the yokes 17 are respectively the same as those in embodiment 1. Each of the magnetic circuits is firmly fixed to the frame 13, and generates magnetic flux in space at an upper side of the magnet 16 and the yoke 17. With an application of a driving current, each of the voice coils 14 generates a driving force which enables the diaphragm 11 to vibrate. Each of the voice coils 14 is of a vertically long rectangle, and is located such that a central axis thereof coincides with that of the diaphragm 11.

Further, as with embodiment 5, a length of a long axis direction of each of the voice coils 14 is not less than 60% of a length of a long axis direction of the diaphragm 11. On the other hand, with respect to a short axis direction, positions of long sides of each of voice coils 14 to be fixed on the diaphragm 11 are, as with embodiment 5, positions where both of primary resonance and secondary resonance in the short axis direction of the diaphragm 11 are suppressed. Specifically, with regard to one voice coil 14 of the two voice coils 14, assuming that a length of a short side of the diagram 11 is 1, one of the long sides thereof is firmly fixed to a position corresponding to 0.113 from an extremity of the short side of the diaphragm 11, and another long side thereof is firmly fixed to a position corresponding to 0.37775. In the case where a constitutional variation such as a shape and a weight of the diaphragm 11 is taken into consideration, a range from 0.1 to 0.15, and a range from 0.35 to 0.4 with respect to the short axis direction of the diaphragm 11 are normally optimum as positions of the long sides of the one voice coil 14 to be mounted on the diaphragm 11. With regard to another voice coil 14, one long side thereof is firmly fixed to a position corresponding to 0.62225 from the extremity of the short side of the diaphragm 11, and another long side thereof is firmly fixed to a position corresponding to 0.887. In the case where the constitutional variation such as the shape and the weight of the diaphragm 11 is taken into consideration, a range from 0.6 to 0.65, and a range from 0.85 to 0.90 in the short axis direction of the diaphragm 11 are normally optimum as positions of the long sides of said another voice coil 14 to be mounted on the diaphragm 11. In the case where a mass and rigidity of the edge 12 cannot be ignored compared to those of the diaphragm 11, positions of nodes of the primary and the secondary resonance modes will change from the above-described positions, and thus positions of the voice coils 14 to be fixed to require to be changed depending on the positions of the respective nodes.

An operation and effects of the loudspeaker constituted as above described will be described. When an electric current is applied to each of the voice coils 14, the driving force is generated in each of the voice coils 14 by the applied electric current and a magnetic field caused by each of the above-described magnetic circuits. With the generated driving force, the diaphragm 11 vibrates, whereby a sound is radiated in space. Here, as with embodiment 1, with respect to the long axis direction of the diaphragm 11, the driving force is applied to no less than 60% of the length thereof. Therefore, the same effect as a case where a whole area of the diaphragm 11 in the long axis direction is driven can be obtained. That is, resonance in the long axis direction can be suppressed. Further, as with embodiment 5, the long sides of each of the voice coils 14 are fixed to positions, with respect to the short axis direction, where both of the primary resonance and the secondary resonance in the short axis direction of the diaphragm 11 are suppressed. Therefore, resonance in the short axis direction can be suppressed. Accordingly, as with embodiment 5, a loudspeaker which has a flat sound pressure/frequency characteristic over a wide range and has little distortion can be realized.

Further, according to embodiment 7, each of the voice coil 14 is formed on the diaphragm 11 with the use of a printed wiring technology, whereby the voice coil 14 can be located at a more precise position compared to a case where a coil made of a wire is bonded to the diaphragm. By locating each of the voice coils 14 at the more precise position, a high sound quality loudspeaker can be realized.

In embodiment 7, although a long side of the printed coil is of a straight line, as with embodiment 3, the long side of the printed coil may be formed in a polygonal line or a curved line (see FIG. 11(*d*)). Accordingly, a range to which the driving force is applied on the diaphragm 11 can be broaden with respect to the short axis direction, whereby the driving force can be assuredly applied to the positions of the nodes of the primary resonance mode in the short axis direction.

Embodiment 8

Figure 19:
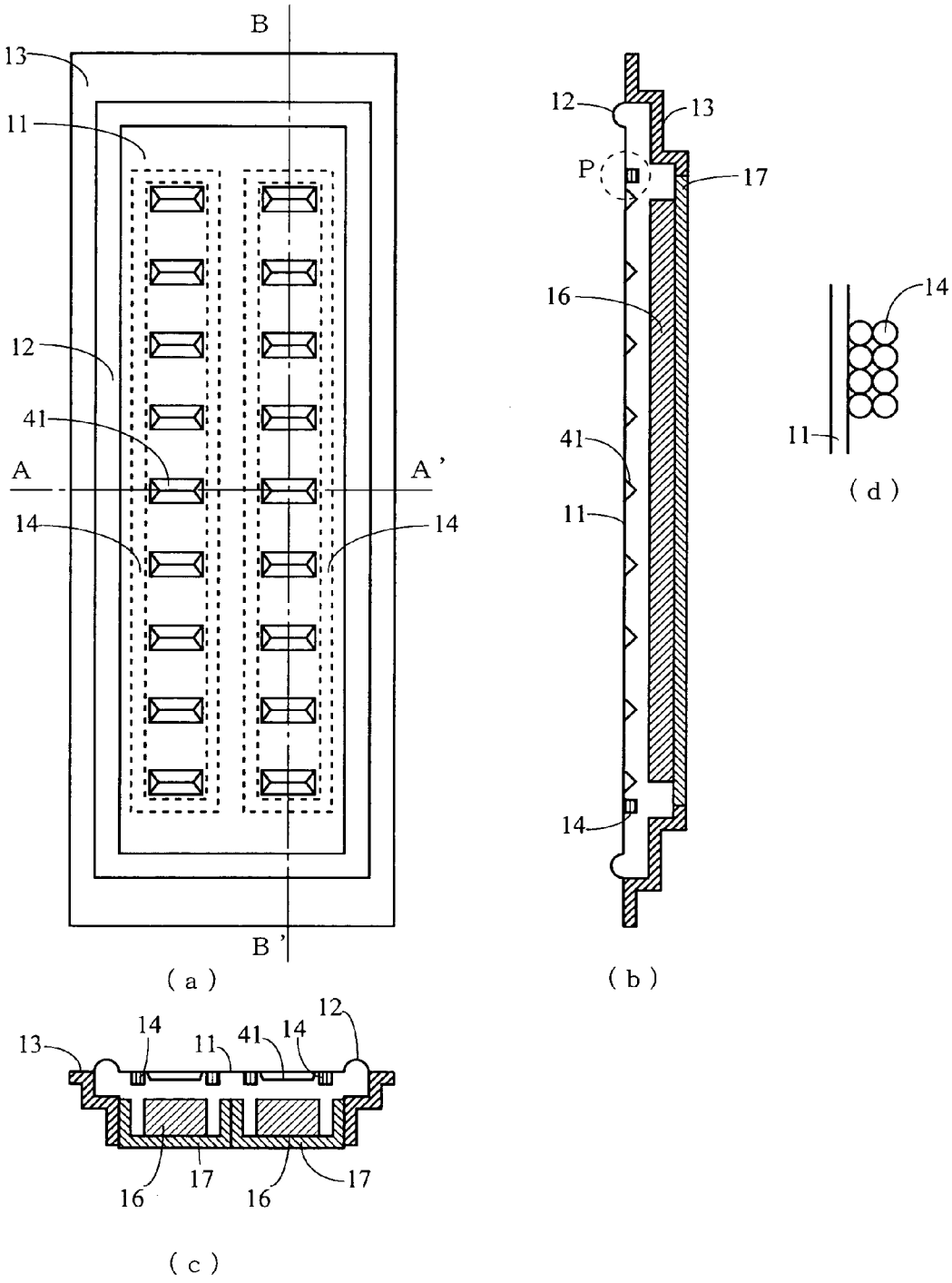
FIG. 19 is a diagram showing a loudspeaker of embodiment 8.

Hereinafter, a loudspeaker according to embodiment 8 will be described. FIG. 19(*a*) is a plan view of the loudspeaker, FIG. 19(*b*) is a cross-sectional view (B-B' cross-sectional view) of a long side of the loudspeaker, and FIG. 19(*c*) is a cross-sectional view (A-A' cross-sectional view) of a short side of the loudspeaker. Note that FIG. 19(*d*) is a partially enlarged view of a region P shown in FIG. 19(*b*). In (*a*) to (*d*) of FIG. 19, component elements respectively having identical functions to the component elements shown in (*a*) to (*d*) of FIG. 1 are respectively provided common reference characters. The loudspeaker according to embodiment 8 is different, in that ribs are provided to a diaphragm 11, from the loudspeaker according to embodiment 5. Since the loudspeaker according to embodiment 8 is similar to that according to embodiment 5 in other points, differences between embodiment 5 and embodiment 8 will be mainly described hereinafter.

In embodiment 8, a plurality of reinforcing ribs 41 is provided to an inner circumference side of a portion where each of voice coils 14 are bonded to diaphragm 11. The reinforcing ribs 41 provide the diaphragm 11 with convexoconcaves. In FIG. 19, each of the reinforcing ribs 41 extends in the short axis direction, and the respective reinforcing ribs 41 are located parallel with respect to one another. With provision of the reinforcing ribs 41 to the diaphragm 11, a bending strength thereof can be increased compared to a planar diaphragm. The bending strength of a short axis direction of the diaphragm 11 is increased, whereby a resonance frequency of a resonance mode in the short axis direction can be raised.

Note that the reinforcing ribs may be provided to the diaphragm in other embodiments than embodiment 8. Further, ribs (tangential ribs) may also be provided to an edge portion.

Further, in above-described embodiments 5 to 8, as shown in FIGS. 14 and 15, a plurality of the voice coils may be located in a long axis direction. Here, a total length of long axis directions of the respective voice coils, which are located in line in the long axis direction, may be no less than 60% of a length of a long axis direction of the diaphragm 11.

Figure 20:
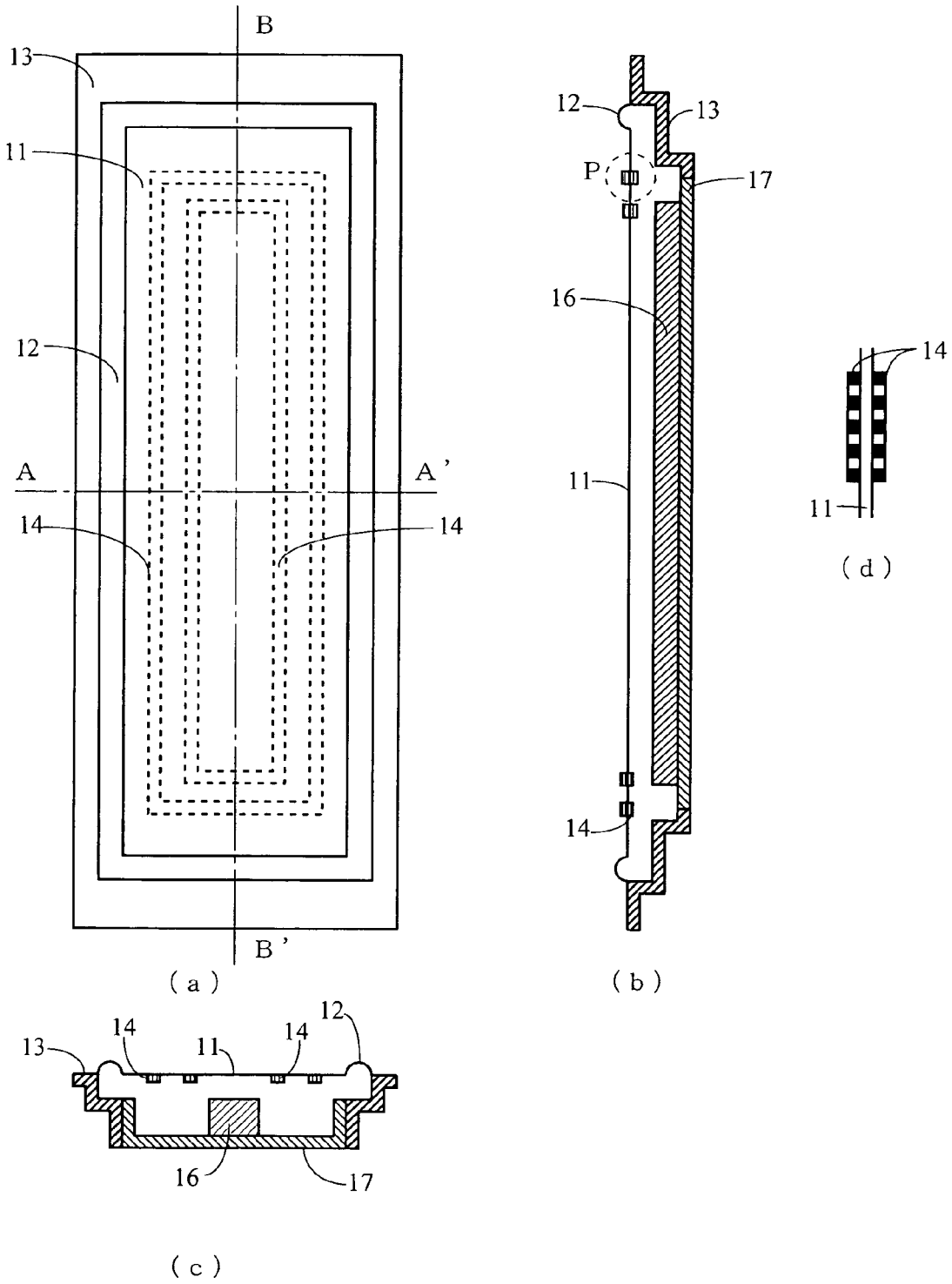
FIG. 20 is a diagram showing a loudspeaker of a different embodiment.
Figure 21:
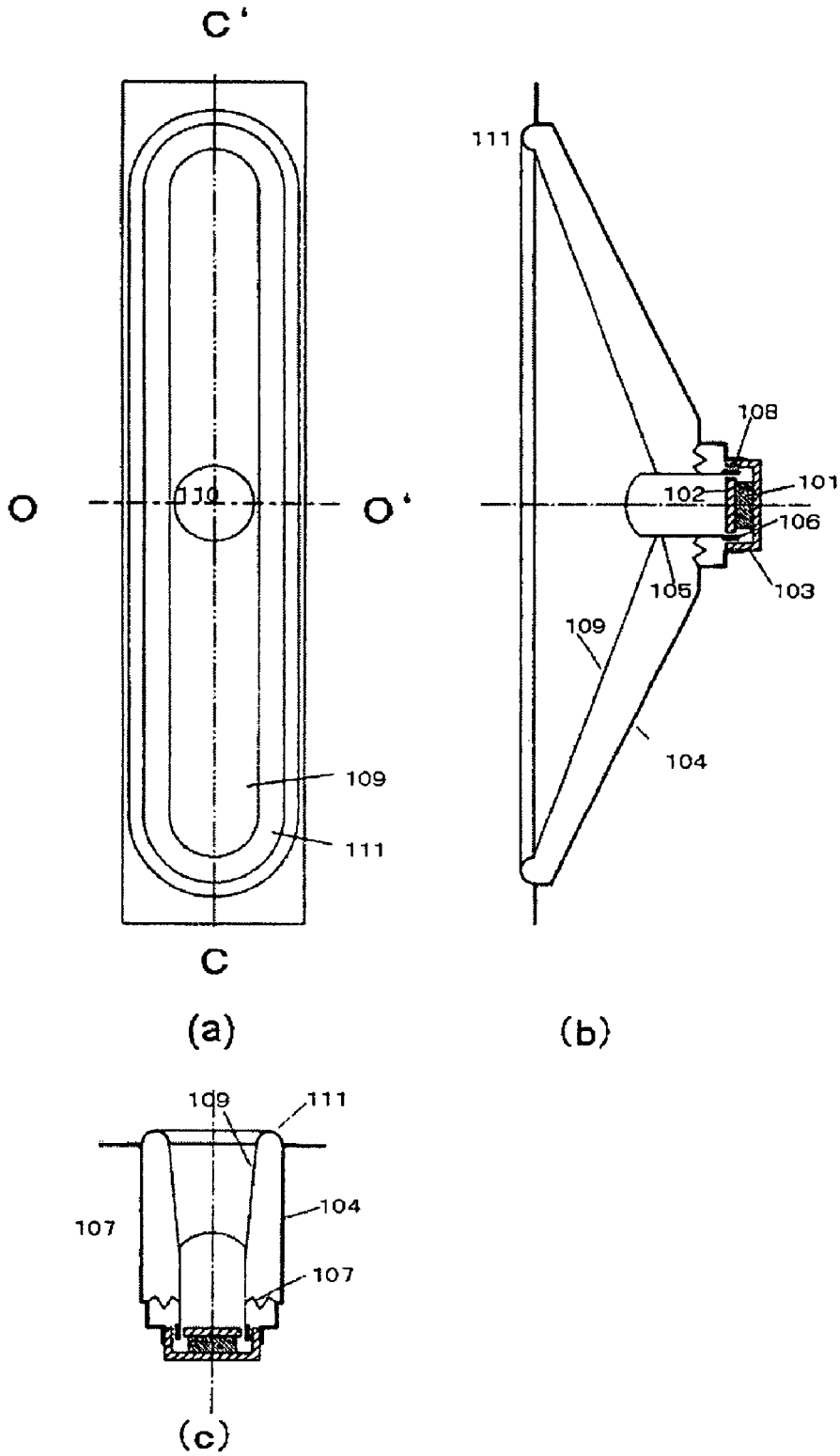
Fig. 21 PRIOR ART
FIG. 21 is a diagram showing a structure of a conventional slim type loudspeaker.
Figure 22:
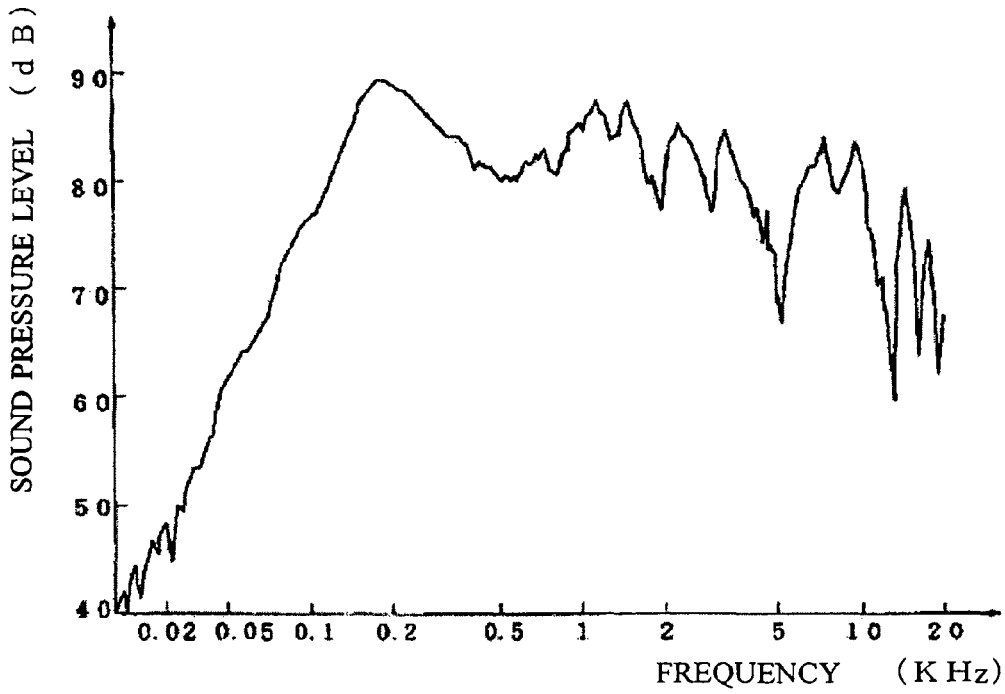
Fig. 22 PRIOR ART
FIG. 22 is a diagram showing a frequency characteristic of a reproducing sound level of the conventional slim loudspeaker.

Further, in above-described embodiments 5 to 8, although two voice coils 14 are located in line in a short axis direction, the two voice coils 14 may be located concentrically. FIG. 20 is a diagram showing alignment of the voice coils in a different embodiment. As shown in FIG. 20, the two voice coils 14 may be aligned concentrically (a center thereof in this case coincides with a center of the diaphragm 11). In FIG. 20, the voice coils 14 are printed coils, and may be planar coils made of a wire. In FIG. 20, with regard to at least one voice coil of the two voice coils 14, the length of the long axis direction thereof may be no less than 60% of the length of the long axis direction of the diaphragm.

Further, in embodiments 1 to 8, the edge portion is of a constitution having a convex portion, and may be of a constitution without a convex portion. That is, a cross-section of the edge portion may be flat. Further, in embodiments 1 to 8, although each of the magnetic circuits according to the present invention is illustrated as a type where a magnet is located inside, different type of magnetic circuit such as a method in which a diaphragm is sandwiched in between two magnets and a type where a magnet is located outside.

Further, the loudspeaker according to the present invention can be easily slimmed and thinned down, and thus is useful to be used for a thin-screen television and an electronic device such as a cellular phone, a PDA, and the like. That is, the electronic device is of a constitution including the loudspeaker according to the present invention and a housing for holding the loudspeaker inside thereof.

INDUSTRIAL APPLICABILITY

As above described, the loudspeaker according to the present invention can be used for the purpose of suppressing a large number of resonances and the like in spite of having an elongated structure.

The invention claimed is:

1. A loudspeaker comprising:

a diaphragm having a vertically long flat plate shape;

an edge operable to support the diaphragm in such a manner that enables vibration thereof;

at least one voice coil directly or indirectly connected to the diaphragm; and a magnetic circuit operable to drive the at least one voice coil, wherein, the magnetic circuit has a vertically long shape and is located such that a longitudinal direction thereof coincides with the longitudinal direction of the diaphragm, the at least one voice coil is of a vertically long shape, a length of long sides thereof is no less than 60% of a length of a longitudinal direction of the diaphragm, and the long sides thereof are connected to the diaphragm so as to be parallel to the longitudinal direction of the diaphragm, whereby a plurality of resonance modes in the longitudinal direction of the diaphragm are suppressed, and with respect to a short axis direction of the diaphragm, positions where the long sides of the at least one voice coil are connected to the diaphragm are set as positions of nodes of a primary resonance mode in the short axis direction of the diaphragm, whereby a resonance mode in the short axis direction of the diaphragm is suppressed.

2. The loudspeaker according to claim 1, wherein when a length of the short axis direction of the diaphragm is 1, one long side of two of the long sides of the at least one voice coil is connected at a position corresponding to a distance of 0.224 from one extremity toward another extremity of the short axis direction of the diaphragm, and another long side of the at least one voice coil is connected at a position corresponding to a distance of 0.776 from the one extremity toward the another extremity of the short axis direction of the diaphragm.

3. The loudspeaker according to claim 1, wherein the magnetic circuit comprises:

a magnet; and a yoke having a bottom surface connected to the magnet and side surfaces facing long sides of the magnet.

4. The loudspeaker according to claim 1, wherein the at least one voice coil is a planar coil which is made of wire and firmly fixed on the diaphragm.

5. The loudspeaker according to claim 1, wherein the at least one voice coil is a printed coil provided on the diaphragm.

6. The loudspeaker according to claim 1, wherein the diaphragm has a plurality of ribs located at an inner circumference side of a position where the at least one voice coil is connected.

7. The loudspeaker according to claim 1, comprising a plurality of voice coils, wherein the respective voice coils are located in line in the long axis direction of the diaphragm.

8. A loudspeaker comprising:

a diaphragm having a vertically long flat plate shape;

an edge operable to support the diaphragm in such a manner that enables vibration thereof;

at least two voice coils directly or indirectly connected to the diaphragm; and magnetic circuits operable to drive the at least two voice coils and a number thereof is a same as that of the at least two voice coils, wherein, the magnetic circuits have vertically long shapes and are located such that longitudinal directions thereof coincide with the longitudinal direction of the diaphragm, the at least two voice coils have a vertically long shape, a length of long sides thereof is no less than 60% of a length of a longitudinal direction of the diaphragm, and the long sides thereof are connected to the diaphragm so as to be parallel to the longitudinal direction of the diaphragm, whereby a plurality of resonance modes in the longitudinal direction of the diaphragm are suppressed, and with respect to a short axis direction of the diaphragm, positions where the long sides of the respective at least two voice coils are connected to the diaphragm are positions where a primary resonance mode and a secondary resonance mode in the short axis direction of the diaphragm are suppressed, whereby a resonance mode in the short axis direction of the diaphragm is suppressed.

9. The loudspeaker according to claim 8, comprising a first voice coil and a second voice coil as the at least two voice coils, wherein when a length of the short axis direction of the diaphragm is 1, one long side of two long sides of the first voice coil is connected at a position corresponding to a distance of 0.113 from one extremity toward another extremity of the short axis direction of the diaphragm, and another long side of the first voice coil is connected to a position corresponding to a distance of 0.37775 from the one extremity toward the another extremity of the short axis direction of the diaphragm, and when the length of the short axis direction of the diaphragm is 1, one long side of two long sides of the second voice coil is connected at a position corresponding to a distance of 0.62225 from the one extremity toward the another extremity of the short axis direction of the diaphragm, and another long side of the second voice coil is connected to a position corresponding to a distance of 0.887 from the one extremity toward the another extremity of the short axis direction of the diaphragm.

10. The loudspeaker according to claim 8, comprising a first voice coil and a second voice coil, which are respectively located concentrically, as the at least two voice coils, wherein when a length of the short axis direction of the diaphragm is 1, one long side of two long sides of the first voice coil is connected at a position corresponding to a distance of 0.113 from one extremity toward another extremity of the short axis direction of the diaphragm, and another long side of the first voice coil is connected to a position corresponding to a distance of 0.887 from the one extremity toward said another extremity of the short axis direction of the diaphragm, and when the length of the short axis direction of the diaphragm is 1, one long side of two long sides of the second voice coil is connected at a position corresponding to a distance of 0.37775 from the one extremity toward said another extremity of the short axis direction of the diaphragm, and another long side of the second voice coil is connected to a position corresponding to a distance of 0.62225 from the one extremity toward said another extremity of the short axis direction of the diaphragm.

11. The loudspeaker according to claim 8, wherein each of the magnetic circuits includes a magnet, and a yoke having a bottom surface connected to the magnet and side surfaces facing long sides of the magnet.

12. The loudspeaker according to claim 8, wherein each of the at least two voice coils is a planar coil which is made of wire and firmly fixed on the diaphragm.

13. The loudspeaker according to claim 8, wherein each of the at least two voice coils is a printed coil provided on the diaphragm.

14. The loudspeaker according to claim 8, wherein the diaphragm has a plurality of ribs located at an inner circumference side of a position where each of the at least two voice coils is connected.

15. The loudspeaker according to claim 8, wherein a plurality of voice coils among the at least two voice coils is located in line in the long axis direction of the diaphragm.

16. An electronics device comprising the loudspeaker described in claim 1.

17. An electronics device comprising the loudspeaker described in claim 8.

18. The loudspeaker according to claim 1, wherein a length of the short axis direction of the diaphragm is no more than 0.5 when the length of the longitudinal direction thereof is 1.

19. The loudspeaker according to claim 8, wherein a length of the short axis direction of the diaphragm is no more than 0.5 when the length of the longitudinal direction thereof is 1.

* * * * *